United States Patent [19]

Ito

[11] Patent Number: 4,935,771

[45] Date of Patent: Jun. 19, 1990

[54] COPYING APPARATUS HAVING AUTOMATIC DOCUMENT FEEDER AND SORTER

[75] Inventor: Masazumi Ito, Azuchi, Japan

[73] Assignee: Minolta Camera Kabushiki Kaisha, Osaka, Japan

[21] Appl. No.: 343,875

[22] Filed: Apr. 27, 1989

[30] Foreign Application Priority Data

| | | | |
|---|---|---|---|
| Apr. 30, 1988 | [JP] | Japan | 63-107836 |
| Apr. 30, 1988 | [JP] | Japan | 63-107837 |
| Apr. 30, 1988 | [JP] | Japan | 63-107838 |
| Apr. 30, 1988 | [JP] | Japan | 63-108313 |

[51] Int. Cl.[5] ..... G03G 15/00

[52] U.S. Cl. ..... 355/66; 355/313; 355/321; 355/323

[58] Field of Search ..... 355/50, 308, 309, 313, 355/314, 321, 323, 72, 75, 66; 271/279, 290

[56] References Cited

U.S. PATENT DOCUMENTS

| | | | |
|---|---|---|---|
| 3,687,540 | 8/1972 | Hashimoto | 355/308 |
| 4,273,439 | 6/1981 | Markham et al. | 355/314 |
| 4,370,052 | 1/1983 | Murakami et al. | 355/323 |
| 4,411,515 | 10/1983 | Kukucka et al. | 355/321 |
| 4,437,660 | 3/1984 | Tompkins et al. | 271/290 |
| 4,442,505 | 4/1984 | Takano | 355/313 |
| 4,561,765 | 12/1985 | Masuda | 355/313 |
| 4,568,177 | 3/1986 | Sato et al. | 355/309 X |
| 4,569,582 | 3/1986 | Hyltoft | 355/202 |
| 4,647,188 | 3/1987 | Komiya et al. | 355/243 X |
| 4,693,590 | 9/1987 | Umeda | 355/313 |

FOREIGN PATENT DOCUMENTS

| | | |
|---|---|---|
| 55-50260 | 4/1980 | Japan . |
| 59-77457 | 5/1984 | Japan . |
| 59-200270 | 11/1984 | Japan . |
| 62-126081 | 6/1987 | Japan . |

*Primary Examiner*—Richard A. Wintercorn

*Attorney, Agent, or Firm*—Burns, Doane, Swecker & Mathis

[57] ABSTRACT

A copying apparatus comprising a first information displaying means disposed on each copied paper discharge bin of a sorter, a second information displaying means disposed on each document discharge bin of an automatic document feeder, and a controlling means, so that the same information such as a number is displayed on a bin into which documents have been discharged and a bin into which copied papers have been discharged after copying has been completed, and in case where either of the documents or the copied papers are removed, an information such as a number on the bins wherein the other are left blinks to raise an alarm, and furthermore, in case where the copied papers are discharged into a plurality of bins and the copied papers are removed from part of the bins, an information such as a number on the bins wherein the other copied papers are left blinks to raise an alarm, and still further, the identification information registered for each documents in advance is displayed on the bin into which the documents have been discharged and the bins into which the copied papers have been discharged.

46 Claims, 43 Drawing Sheets

Fig. 7

| PARAMETER / DOCUMENT FEED UNIT NUMBER | DOCUMENT EXISTS | COPY BEING DONE | SEQUENCE NUMBER | NUMBER OF COPIES | DISCHARGE UNIT NUMBER | JOB MODE | NUMBER OF DOCUMENT SHEETS | RESERVA-TION NUNBER | SORTER MODE |
|---|---|---|---|---|---|---|---|---|---|
| 1 | 1 | 1 | 2 | 10 | 4 | 0 | 1 | 8 | 3 |
| 2 | 1 | 0 | 3 | 3 | 1 | 2 | 3 | 2 | 1 |
| 3 | 0 | 0 | 1 | 5 | 5 | 0 | 5 | 4 | 2 |
| ⋮ | ⋮ | ⋮ | ⋮ | ⋮ | ⋮ | ⋮ | ⋮ | ⋮ | ⋮ |
| n | — | — | — | — | — | — | — | — | — |

COPYING APPARATUS HAVING AUTOMATIC DOCUMENT FEEDER AND SORTERBACKGROUND OF THE INVENTION

1. Field of the Invention

The present invention relates to a copying apparatus being provided with a multi-job function including a sorter which has a plurality of copied paper discharge bins and has a function of automatically distributing and discharging copied papers, and an automatic document feeder (hereinafter, referred to as ADF) which processes copy operation of a plurality of groups of documents according to a predetermined sequence and discharges each of them to a predetermined document discharge bin.

2. Description of Related Art

In the copying apparatuses being provided with the ADF, various types comprises the so-called multi-job function have been developed which save the time required for the user to wait his turn in a manner that, for example, copying operations for each groups of documents of a plurality of users set on a plurality of paper feed trays are automatically processed in sequence.

For example, in the Japanese Patent Application No. 62-321924 (1987), the inventor of this application proposed a copying apparatus having the so-called multi-job function which is so constituted that when some groups of documents are not required to be copied soon, the other groups of documents are copy-processed preferentially irrespective of the setting sequence of documents, and when no other group of documents is left, the groups of documents having been put aside starts to be copy-processed.

Then, particularly in the copying apparatus having such a multi-job function, the user is given a convenience by an additional use of a sorter which sorts copied papers and discharges them into bins separately one by one group.

Then, by the copying apparatus as described above, the copy processing is often performed in the unmanned state. For this reason, after completing the copy processing, the user of the copying apparatus is difficult to identify the bin into which the documents which is copied by the user himself have been discharged and the bin into which the copied papers have been discharged, respectively. Particularly, as to the copied paper, the respective bins of the sorter are stacked in the vertical direction, so that the inside thereof is very hard to be seen, therefore it is necessary to take out copied papers from each bin in sequence to check them. Also, in case where the so-called sorting or grouping mode is performed, copied papers are distributed and discharged into a plurality of bins, and therefore it is also possible to forget to take out one or some of them.

SUMMARY OF THE INVENTION

The present invention has been achieved in the light of such circumstances. A first object of the present invention is to provide a copying apparatus which is given a consideration so that a bin into which documents are discharged and a bin into which copied papers copied therefrom are discharged can be easily identified respectively after completing copy processing.

A second object of the present invention is to provide a copying apparatus which is given a consideration so that if either of documents and copied papers are found, the other can also be found easily after completing copy processing.

A third object of the present invention is to provide a copying apparatus which is given a consideration so that the user does not forget to take out all of copied papers by sorting or grouping processing even where copied papers are discharged into a plurality of bins.

A fourth object of the present invention is to provide a copying apparatus which is given a consideration so that a bin into which documents are discharged and a bin into which copied papers copied therefrom are discharged can be easily found respectively after completing copying.

A copying apparatus of the present invention comprises a first information displaying means disposed on each copied paper discharge bin of a sorter, a second information displaying means disposed on each document discharge bin of an automatic document feeder, and a controlling means which displays information related mutually to the second information displaying means disposed on the document discharge bin and the second information displaying means disposed on one or a plurality of copied paper discharge bins into which the copied papers copied from the corresponding documents are discharged after completing copy processing of each group of documents. Thereby, information such as a same number mutually corresponding to the bin into which the documents are discharged and the bins into which the copied papers copied therefrom are discharged is displayed thereon after completing copy processing.

Also, a copying apparatus of the present invention comprises a first information displaying means disposed on each copied paper discharge bin of a sorter, a second information displaying means disposed on each document discharge bin of an automatic document feeder, a first sensor detecting existence of copied papers in each copied paper discharge bin of the sorter, a second sensor detecting existence of documents in each document discharge bin of the automatic document feeder, and a controlling means which, when removal of documents from any of the document discharge bins has been detected by the second sensor, raises an alarm by the first information displaying means disposed on one or a plurality of copied paper discharge bins into which the copied papers of the removed documents have been discharged, and when removal of copied papers from any of the copied paper discharge bins has been detected by the first sensor, raises an alarm by the second information displaying means disposed on the document discharge bin into which the documents corresponding to the removed copied papers have been discharged. Thereby, when the documents are removed after completing copy processing, the bin into which the copied papers have been discharged is displayed, and when the copied papers are removed, the bin into which the documents thereof have been discharged is displayed, respectively.

Furthermore, a copying apparatus of the present invention comprises an information displaying means disposed on each copied paper discharge bin of a sorter, a sensor detecting existence of copied papers in each copied paper discharge bin of the sorter, and a controlling means which, when removal of copied papers from any of copied paper discharge bins has been detected by the sensor, raises an alarm at an information displaying means disposed on one or a plurality of other copied paper discharge bins into which the copied papers copied from the same group of documents. Thereby, in case where copied papers are discharged into a plurality of bins by sorting or grouping processing, when the copied papers are removed only from one bin among then, it is displayed that the copied papers copied from the same documents are left in the other bins.

Furthermore, a copying apparatus of the present invention comprises a registering means for registering identification information for identifying each group of documents, a first information displaying means disposed on each copied paper discharge bin of a sorter, a second information displaying means disposed on each document discharge bin of an automatic document feeder, a controlling means which displays the identification information registered by the registering means on the second information displaying means disposed on the document discharge bin and the first information displaying means disposed on one or a plurality of copied paper discharge bins into which the copied papers copied from the documents have been discharged after completing copy processing of each group of documents. Thereby, identification information such as the reservation number of sequence of copy processing registered at setting documents in the ADF is displayed on the bins into which the documents and the copied papers copied therefrom have been discharged after completing the copy processing.

The above and further objects and features of the invention will more fully be apparent from the following detailed description with accompanying drawings.

BRIEF DESCRIPTION OF THE DRAWINGS

FIG. 7 is an explanatory view of a RAM map of a RAM incorporated in a CPU.

FIGS. 1(*a*) and 1(*b*) are a major portion broken and front view showing the construction of a copying apparatus according to the invention. In addition, FIG. 1(*a*) shows a main body of the copying apparatus and FIG. 1(*b*) shows two sorters 600 and 650, respectively.

Figure 1:
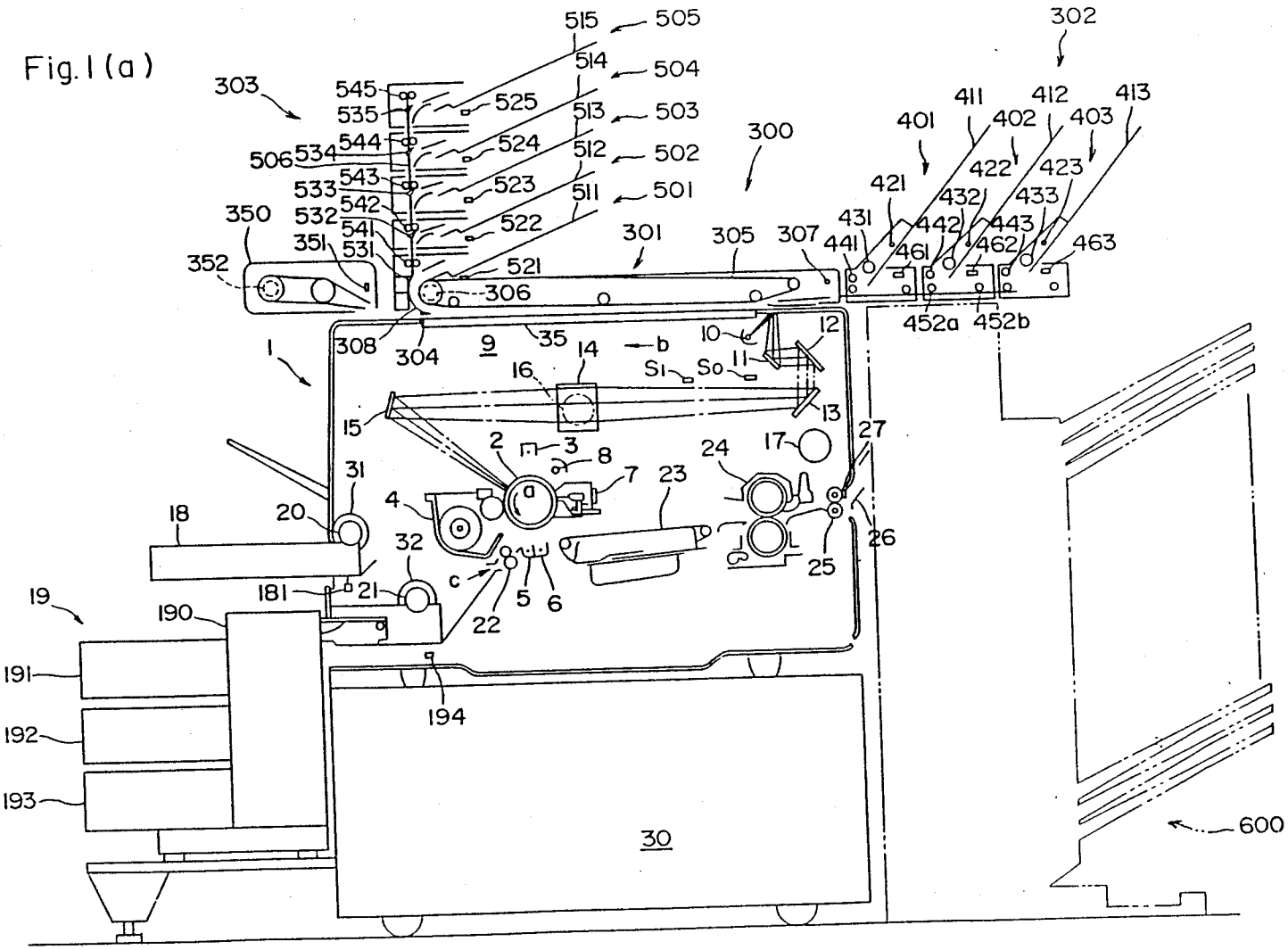
FIGS. 1 is a major portion broken and front view shows the construction of a copying machine according to the present invention and FIG. 1(*a*) shows a body thereof and FIG. 1(*b*) shows sorters thereof.
Figure 1:
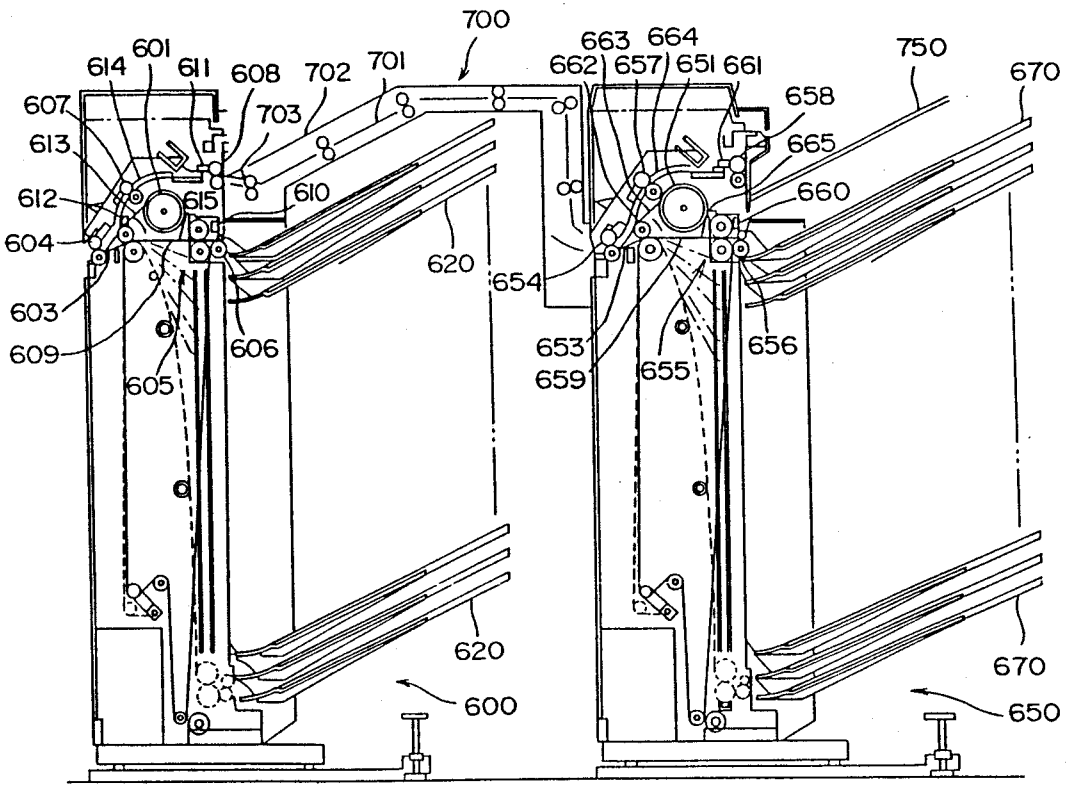

A main body 1 of the copying apparatus is mounted on a desk 30, and on the upper portion of the main body 1, an ADF 300 is mounted and first and second sorters 600 and 650 are mounted on its right side portion respectively.

In the figure, reference numeral 2 denotes a photosensitive drum having a light conductive layer on its peripheral surface which is rotatable in a direction of an arrow a. Above the photosensitive drum 2, there is disposed a charger 3 which applies an electric charge having a constant potential to the surface of the photosensitive drum 2.

Above the photosensitive drum 2 and the charger 3 and under a document table 35, an image exposing device 9 is disposed. The image exposing device 9 comprises an exposure lamp 10, movable mirrors 11, 12 and 13, a lens 14 and a reflection mirror 15 etc. A first slider consisting of the exposure lamp 10 and movable mirror 11, and a second slider consisting of the movable mirrors 12 and 13 are moved in a direction of an arrow b by a slider driving motor 17.

Moving speeds of the first and second sliders are respectively V/n and V/2n times (n being a copying magnification) in relation to a peripheral speed V of the photosensitive drum 2 (which is constant irrespective of equal or variable magnification) respectively.

When the magnification is changed, a lens moving motor 16 is operated, and in FIG. 1, the lens 14 showing the position of equal magnification is moved respectively in the inverse direction of the arrow b or apart from the photosensitive drum 2 at the time of enlarge-processing, and in the direction of the arrow b or approaching the photosensitive drum 2 at the time of reduce-processing. These movements of each portion of the image exposing device 9 are detected by sensors $S_0$ and $S_1$.

A developing device 4 is provided at the position in the rotating direction of the photosensitive drum 2, against the charger 3. The developing device 4 develops an electrostatic latent image formed on the photosensitive drum 2 into a toner image.

Under the photosensitive drum 2 or at the position in the rotating direction of the photosensitive drum 2, against the developing device 4, there is provided a transfer charger 5. The transfer charger 5 transfers the toner image, formed on the photosensitive drum 2 by the developing device 4, onto the paper to be copied (not shown) transported in a direction of an arrow c.

Next to the transfer charger 5, a separation charger 6 is disposed. The separation charger 6 separates the copied paper from the photosensitive drum 2 immediately after the transfer.

A cleaning device 7 is installed posterior to the separation charger 6. The cleaning device 7 removes a toner remained on the photosensitive drum 2.

Between the cleaning device 7 and the charger 3, there is provided an eraser lamp 8. The eraser lamp 8 removes by irradiating light the electric charge remained on the photosensitive drum 2.

Numerals 18 and 19 indicate an upper cassette and three-stage paper feed unit for containing paper to be copied respectively. They are detachable with respect to upper and lower paper inlets of a main body 1 of the copying apparatus respectively. At the upper paper inlet, a paper feed roller 20 for sending out the paper to be copied and size detecting switches 181 for detecting the size of paper placed in the upper cassette 18 are provided.

In the three-stage paper feed unit 19, a paper feed roller (not shown) and cassettes 191, 192 and 193 having size detecting switches (not shown) are mounted on a common transport portion 190 respectively. Paper is fed from the upper portion of the transport portion 190 to the paper inlet under the upper cassette 18 of the main body 1. At the lower paper inlet, a paper feed roller 21 and size detecting switches 194 are disposed in the same way as the upper paper inlet. A paper feed cassette similar to the upper cassette can also be mounted to the lower paper inlet in place of the three-stage paper feed unit 19. At this time, the paper to be copied contained in the paper feed cassette is sent out by the paper feed roller 21 and its size is detected by the size detecting switches 194.

The paper feed rollers 20 and 21 are coupled to motors 31 and 32 so as to be rotated respectively. The paper to be copied sent out from the cassette is sent between the photosensitive drum 2 and the transfer charger 5 by the timing roller pair 22 in synchronism with the rotational timing of the toner image of the photosensitive drum 2 as shown by the arrow c. The copied paper with the toner transferred image is now introduced into a fixing device 24 by means of a transport belt 23.

The fixing device 24 fuses and fixes the toner image thermally onto the copied paper. The copied paper onto which the image is fixed is introduced into a sorter 601 from a paper outlet 26 of the main body 1 through a roller pair 25. A sensor 27 for detecting discharge of the copied paper from the main body 1 is disposed on the paper outlet 26.

First and second sorters 600 and 650 have the same construction, and the former is connected to the main body 1 while the latter is connected to the former by means of a bridge 700.

The first sorter 600 (or second sorter 650) comprises a plurality of bins 620 (or 670) arranged vertically in parallel for sorting and containing the copied paper in a sorting mode or a grouping mode. Respective bins 620 (or 670) is provided with sensors 698A to 698T (or 699A to 699T) for detecting existence of the copied paper fed out. On the feeding portion of the copied paper, a roller pair 604 (or 654) and a sensor 612 (or 662) for detecting the copied paper fed into the sorter are disposed. Immediately after the roller pair 604, a selection claw 603 (or 653) for switching transport of the copied paper to a non-sorting passage 614 (or 664) or to a sorting passage 615 (or 665) is disposed.

The sorting passage 615 (or 665) is constituted by an endless transport belt 609 (or 659) for transporting the copied paper to a paper discharge unit 605 (or 655) and a retractable tape 613 (or 663). The copied paper transported through the sorting passage 615 (or 665) is detected by a sensor 610 (or 660). The paper discharge unit 605 (or 655) includes a paper discharge roller pair 606 (or 656) for discharging the copied paper to the bins 620 (or 670), and constructed to move up and down intermittently throughout the disposed width of the bins 620 (or 670) by a bin moving motor not shown.

The non-sorting passage 614 (or 664) is so constructed as to discharge the copied paper to the bridge 700 (or a non-sorting tray 750). In the passage 614 (or 664), a relay roller pair 607 (or 657), paper discharge roller pair 608 (or 658) and sensor 611 (or 661) for detecting the transport of copied paper are disposed for this purpose. The roller pairs are rotated by a sorter motor 601 (or 651).

The bridge 700 includes a transport passage 701 therein, and further provided with a selection claw 703 for switching transport of the copied paper discharged from the paper discharge roller pair 608 to the transport passage 701 or to a paper discharge portion 702 constructed on the tilted portion of the bridge 700, at a position facing the paper discharge roller pair 608 of the first sorter.

The transport passage 701 of the bridge 700 is formed by a plurality of roller pairs and guide plates, whose end portion, namely, the paper outlet of the bridge 700, is connected to the paper inlet of the second sorter 650. The paper discharge tray 750 is provided at the paper outlet of the second sorter 650 where a paper discharge roller pair 658 is disposed.

That is, by using the first and second sorters 600 and 650 in connection as aforementioned, when either the sorting mode or the grouping mode is set, the copied paper is transported through the sorting passage 615, distributed to respective bins 620 form the paper discharge unit 605, and when all the bins 620 of the first sorter 600 are filled and still the bin is required, the copied paper is transported to the non-sorting passage 614, sent to the second sorter 650 by the bridge 700 and contained in the bins 670.

The ADF 300 comprises a document transport control portion 301 for moving and stopping a document on the document table 35, a document feed portion 302 for feeding a document to the document transport control portion 301, a document reversing unit 350 for reversing and setting again a document, whose upper side is copied, on the original table 35 and a document discharge portion 303 for receiving the document sent from the transport control portion 301.

The document transport control portion 301 transports a document by means of a rotation belt 305 driven by a motor 306. A sensor 307 is provided on the inlet side of a document so as to detect feeding of the document. A sensor 308 is installed on the outlet side so as to detect discharging of the document.

The document feed portion 302 comprises document feed units (hereinafter referred to as DFU) 401, 402 and 403 which are detachable one another. The DFU 401 is coupled to the document transport control portion 301, the DFU 402 to the DFU 401 and the DFU 403 to the DFU 402.

The DFU 401 (or 402, 403) comprises a document tray 411 (or 412, 413) capable of placing thereon a plurality of document sheets, a delivery roller 431 (or 432, 433) for delivering the documents one by one therefrom, document transport rollers 451*a*, 451*b* (or 452*a*, 452*b*, 453*a*, 453*b*) and an operation panel 461 (or 462, 463). The delivery roller 431 (or 432 433) and the rollers 451*a*, 452*a* (or 452*a*, 452*b*, 453*a*, 453*b*) are operated by a motor 441 (or 442, 443) provided in each unit. A sensor 421 (or 422, 423) detects the presence and absence of the document on the document tray 411 (or 412, 413).

Figure 2:
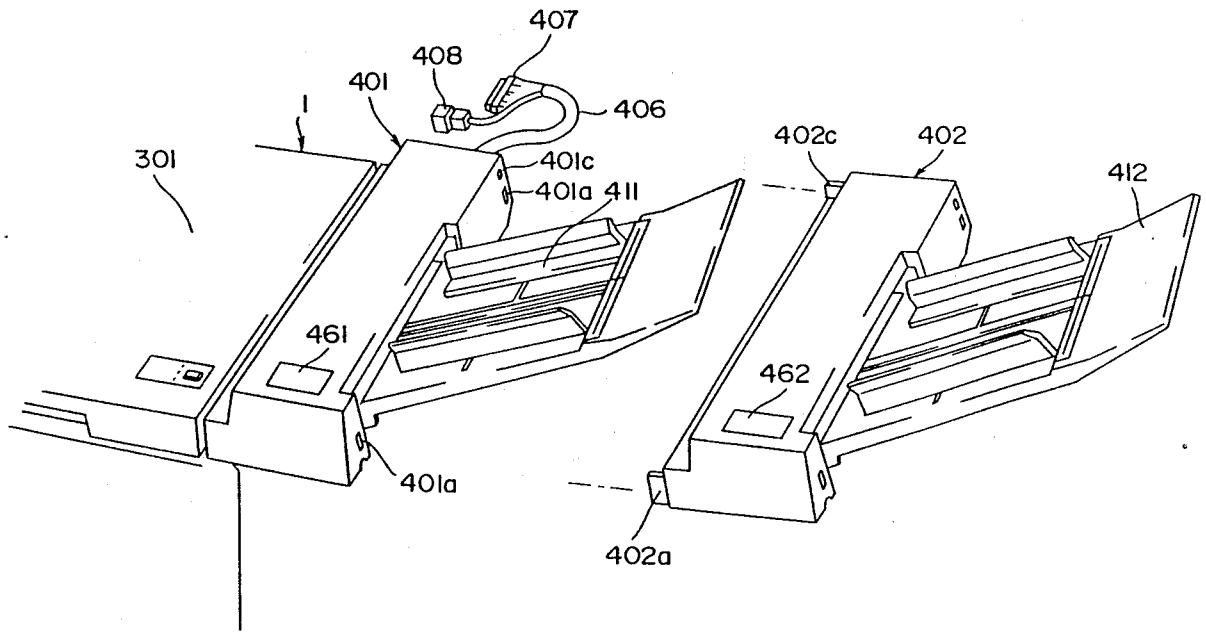
FIGS. 2 and 3 are partial external perspective views thereof.

FIG. 2 shows a specific example of the DFU. In addition, the DFU 401 and the DFU 402 which is disposed in immediately right are shown.

As can be seen from the DFU 402, coupling portions for coupling units each other are provided in front and the rear of the casing. At the front end of the casing, there are provided coupling claws 402*a* projecting forward from both lateral sides so as to engage to coupling holes 401*a* formed at the rear end of the casing. Electrically, they are connected by connectors 402*c*, 401*c*. Connection by the connectors establishes a channel for supply of electric power and signals between the DFUs. The DFU 401 coupled to the document transport control portion 301 has also a connector 402*c* in principle, so that it can be electrically connected to the document transport control portion 301. However, in order to assure electrical connection, a cable 406 may be drawn from the DFU 401 such that a signal line connector 407 and a power supply connector 408 can be connected to the document transport control portion 301 or to the main body of the present apparatus 1 through the cable 406.

As shown in FIG. 1, the document discharge portion 303 has vertically arranged multiple-stage bin, that is, paper discharge trays 511 to 515 and consists of document discharge units (hereinafter referred to as DDUs) 501, 502, 503, 504 and 505 which are detachable from each other by every paper discharge tray.

The DDU 501 is coupled to the document transport control portion 301, the DDU 502 to the DDU 501, the DDU 503 to the DDU 502, the DDU 504 to the DDU 503 and the DDU 505 to the DDU 504. When these DDUs 501 to 505 are coupled each other, a transport passage 506 for the discharged document is formed from a lower level to an upper level.

The DDUs 501 to 505 comprise selection claws 531, 532, 533, 534 and 535 respectively for switching the transport of the document to the transport passage 506 or to the respective discharge trays. The DDUs 501 to 505 also comprise roller pairs 541, 542, 543, 544 and 545 for sending the document to the transport passage 506. Each of the selection claws 531 to 535 is operated by an electro-magnetic solenoid coupled thereto.

Though the roller pairs 541 to 545 are designed to operate in principal by a small-sized motor provided in each unit, they may be operated by the driving force of a motor (not shown) installed externally on the document discharge portion 303 or the motor of the document transport control portion 301. Sensors 521 to 525 disposed under respective paper discharge trays 511 to 515 detect existence of the document on respective paper discharge trays.

Figure 3:
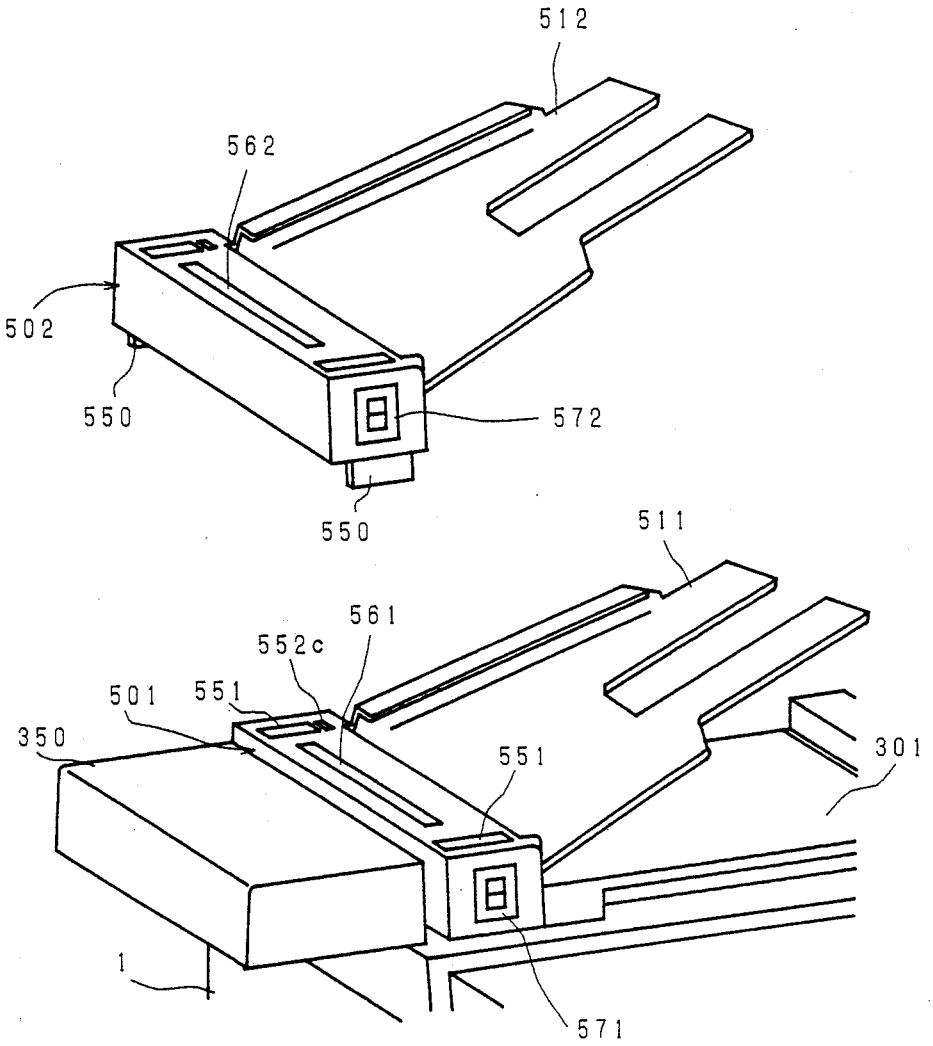

FIG. 3 shows a specific example of the DDUs.

The DDUs are coupled to each other when the coupling claws 550 formed on the lower surface of the casing of the DDU 502 are engaged with the coupling holes 551. The DDUs are electrically connected by coupling a connector (not shown) projecting downward from the lower surface of the casing to a connector 552*c* provided on the upper portion of the casing. Elongated lateral holes 561, 562, together with elongated holes at the lower surface of the casing, serve as outlets and inlets for the document passing through the DDUs.

A document reversing unit (hereinafter referred to as an R unit) 350 is provided with a reversing motor 352 for driving the R unit 350 and a document detection sensor 351 therein. At the rear end of the document transport control portion 301, a selection claw 304 for switching the document discharged from the document table 35 to the DDUs 501 to 505 or to R unit 350 is installed.

The DDUs 501 to 505 are provided with document discharge unit data display 571 to 575 at the side of casing thereof respectively.

Figure 4:
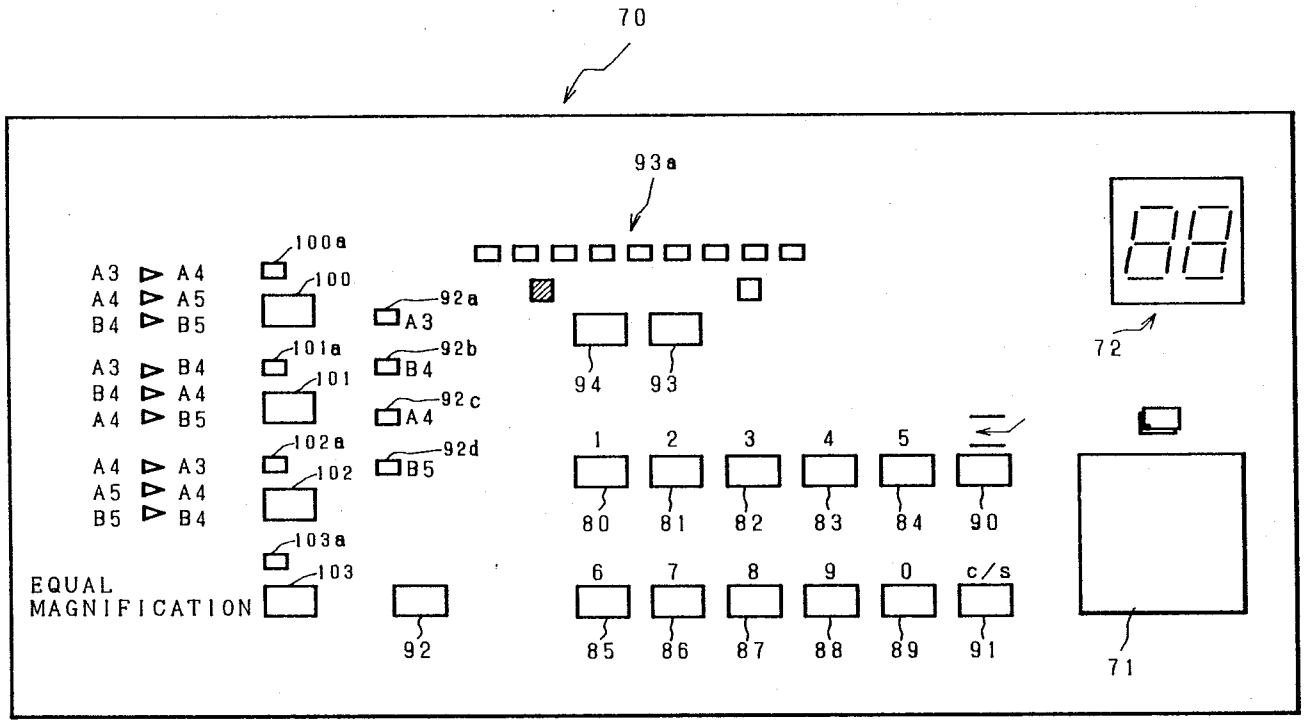
FIGS. 4 and 5 are layout views of an operation panel thereof, FIGS. 6(*a*), 6(*b*) and 6(*c*) are major portion block diagrams of control circuits thereof.

FIG. 4 shows an operation panel 70 provided in front of the document table 35.

Numeral 71 denotes a print key for starting copying operation and 72 is a display for displaying the number of copies. Ten keys 80 to 89 are used principally to input the number of copies. An interrupt copying key and a clear/stop key for canceling the set number and interrupting copying are indicated by 90 and 91. A paper select key 92 is a key for selecting any of paper inlets. Displays 92*a* to 92*d* display the size of sheets contained in the selected cassette. The density of an image to be copied can be set by operations by means of exposure up/down keys 93, 94. A display 93*a* shows a rate of the set image density.

Numerals 100 to 103 denote keys for selecting copying magnifications. Displays 100*a* to 102*a* display the selected magnification. On the operation panel 70, there are also provided an operation key (not shown) and so on for copying both sides of the document.

Figure 5:
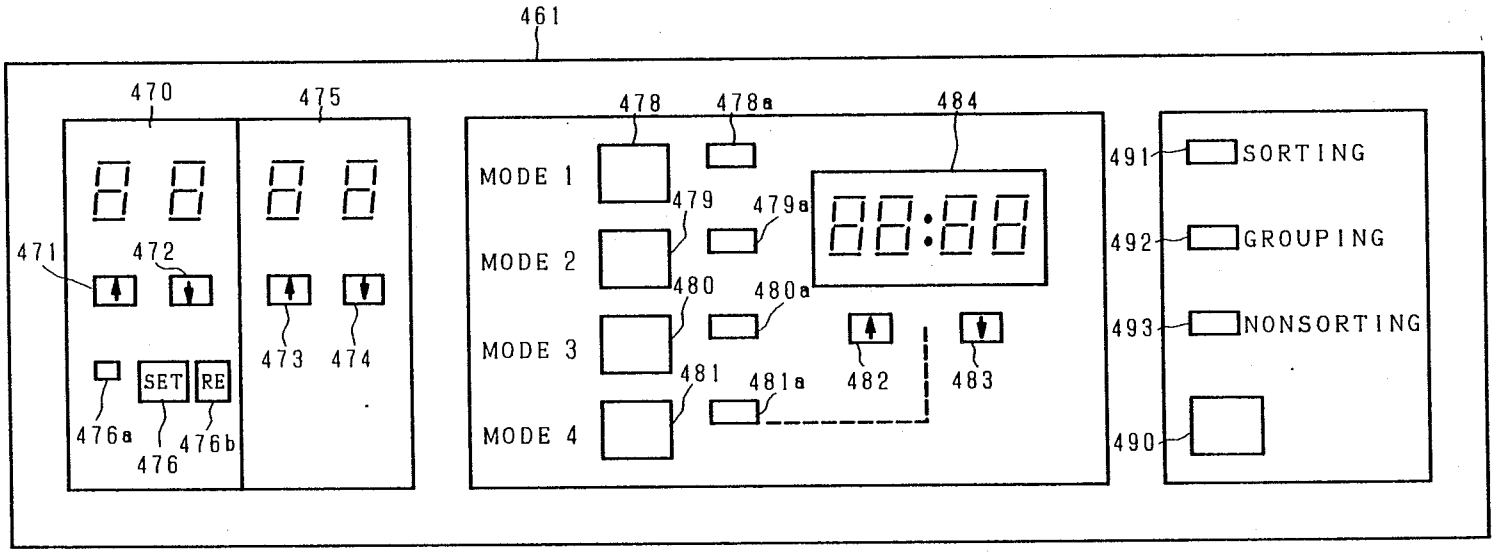

FIG. 5 shows operation panel 461 (or 462, 463) disposed on the DFU 401 (or 402, 403).

A numeral 470 is a display for indicating the number of copies for one sheet of a document. The display 470 comprises an increment key 471 and decrement key 472, a set key 476 for setting the number of copies, a display 476*a* for displaying the completion of setting the number of copies, a reservation number registering key 476*b*. The reservation number registering key 476*b* is used for registering the sequence number of copying document as the reservation numbers.

That is, when the reservation number registering key 476*b* is operated with setting value by the increment key 471 or the decrement key 472, display value on the display 470 at the time is set as the reservation number.

A display 475 for displaying the number of document sheets is provided at the right side of the display 475. The display 475 comprises an increment key 473 and decrement key 474 for setting the number of document sheets.

Also, the operation panel 461 comprises key switches 478, 479, 480 and 481 for selecting processing modes (job modes) of a document, job displays 478*a*, 479*a*, 480*a* and 481*a*, a time display 484 for displaying the copying completion time, an increment key 482 and a decrement key 483 for the completion time settings, a key switch 490 for selecting processing modes (sorting modes) of the copied paper at the first and second sorters 600, 650 and displays 491, 492, 493 for displaying a sorting mode, grouping mode and non-sorting mode respectively.

Job mode 1

After the operation of one DFU has been started in the job mode 1, the operation is not interrupted until the completion of the operation even when documents are set in the other DFUs. This mode is advantageous for the next user when the number of document sheets and copies is small.

Job mode 2

In response to setting documents in the other DFU while one DFU is operating in the job mode 2, the operation in the job mode 2 is interrupted after a preset number of copies from the document placed on the document table 35 are taken, and thereafter the DFU which is newly set documents start the operation thereof.

Job mode 3

In response to setting documents in the other DFU while one DFU is operating in the job mode 3, the operation in the job mode 3 is interrupted immediately after one copy being produced is taken, and thereafter the DFU which is newly set documents start the operation thereof.

Job mode 4

In the job mode 4, the copying completion time of the set document can be designated.

Constructions of other operation panels 462 and 463 disposed on DFUs 402 and 403 we substantially as same as that of the operation panel 461.

Figure 6A:
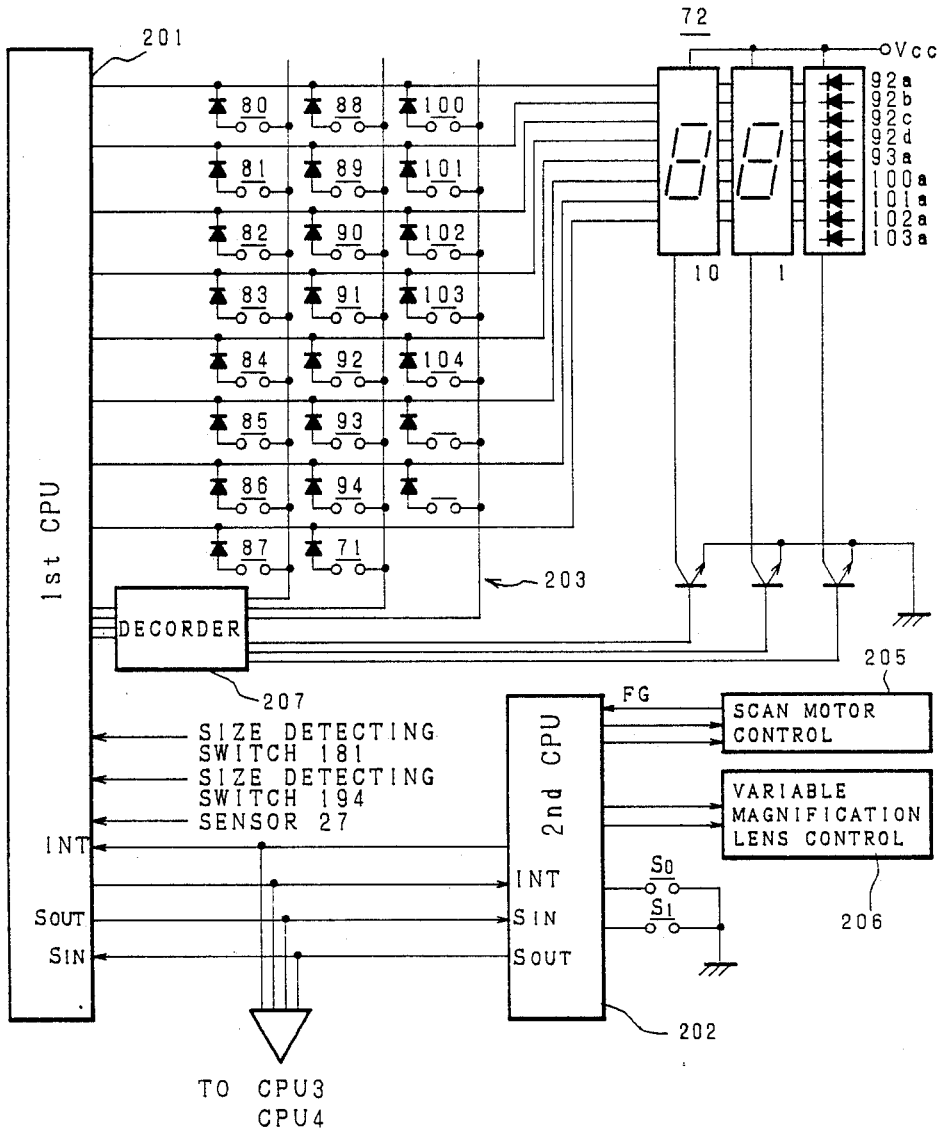
Figure 6B:
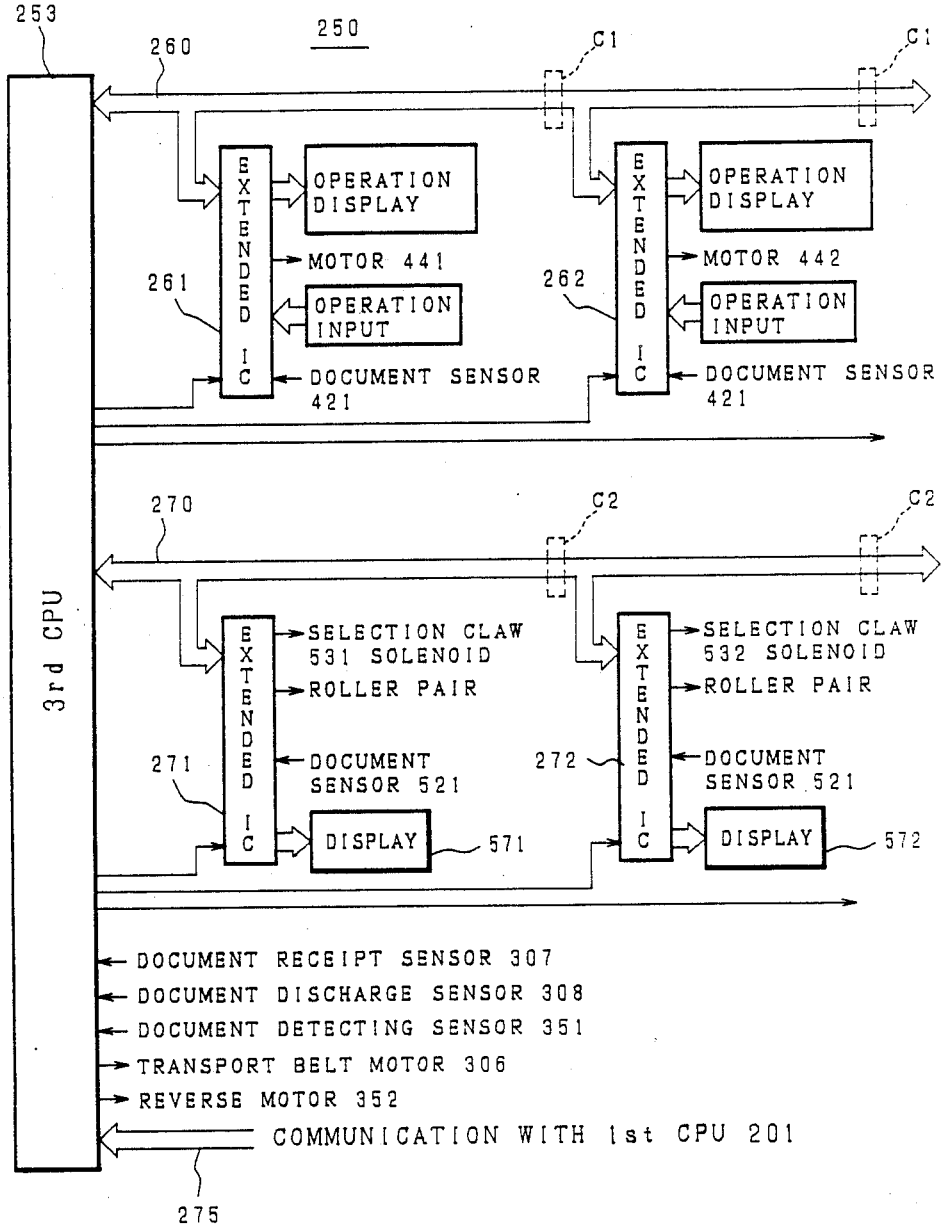
Figure 6C:
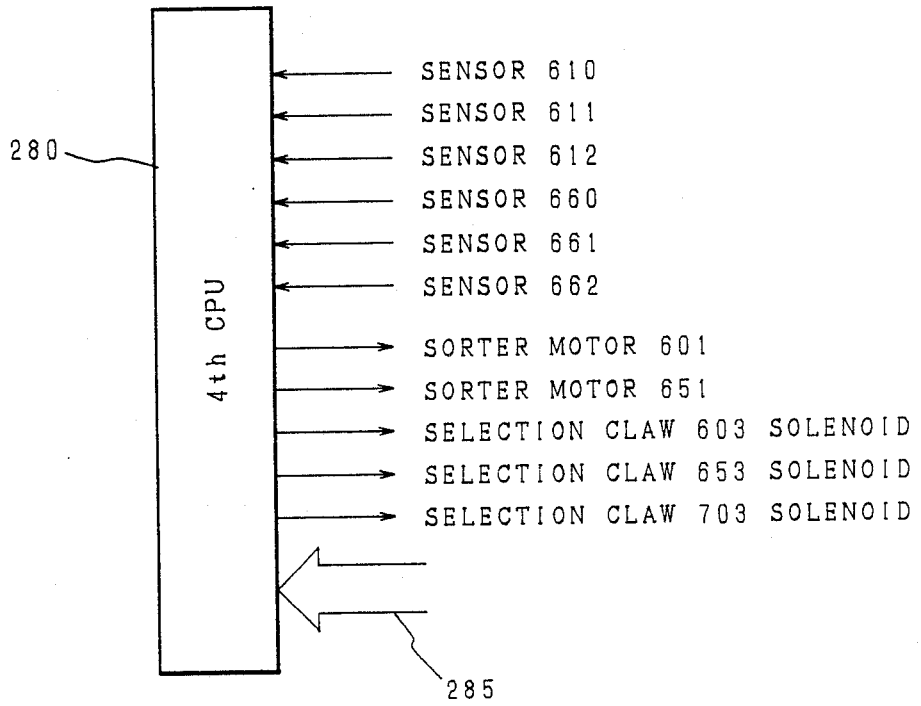

FIGS. 6(*a*), 6(*b*) and 6(*c*) are block diagrams of control circuits of the copying apparatus of the present invention apparatus which is comprising; a microcomputer 201 (first CPU) for controlling copying operation, a microcomputer 202 (second CPU) for controlling a scanning optical system, a microcomputer 253 (third CPU) for controlling the ADF 300 and a microcomputer (fourth CPU) 280 for controlling the first and second sorters.

The first CPU 201 is connected through a decoder 207 to a switch matrix 203 comprising key groups of the operation panel and switches of various sensors, the copy number display 72 and light emitting diodes 92*a* to 92*d*, 93*a*. . . , 103*a* for various displays. The first CPU 201 is also connected to the size detecting switches 181 and 194 for detecting sizes of the paper to be copied and the sensor 27 for detecting the paper discharged from the paper outlet 26. An output port for controlling copying operation is connected with respective driving circuits (not shown) of a main motor, a developing motor, a timing roller clutch, clutches for upper and lower paper feed rollers 21 and 22, a charger 3, a transfer charger 5 etc. In addition, an interrupt signal input terminal INT and data input/output terminals $S_{IN}$, $S_{OUT}$ are connected to the associated terminals of the second CPU 202 such that communication of data is made mutually.

The second CPU 202 is connected with a scan motor control circuit 205 for controlling operation of the slider driving motor 17, a variable magnification lens control circuit 206 for controlling operation of the lens moving motor, scanning control sensors $S_0$, $S_1$ and so on.

FIG. 6(*b*) shows a block diagram of the third CPU 253 for controlling the ADF 300.

The third CPU 253 is connected with a signal bus 260 for the document feed portion as well as a signal bus 270 for the document discharge portion. As for the document transport control portion, at least sensors 307, 308 and the document detecting sensor 351 of the R unit 350 are connected to an input port, and driving portions of a transport belt motor 306 and reversing motor 352 are connected to an output port.

The signal bus 260 is extensible through a connector portion C1 comprising a connector 401*c* and a connector 402*c* shown in FIG. 2. The signal bus 260 is connected with input/output extended ICs 261, 262 . . . incorporated in the respective DFU in parallel.

For this extended IC, for example, a product 8243 of Intel Corporation may be used. The extended IC 261 is connected through a driver with displays on the operation panel of the DFU such as the copy number display 470, set completion display 476*a*, document number display 475, job mode displays 478*a* to 481*a*, time display 484 and sorting mode displays 491 to 493 etc., and also with operating portions such as keys 471 to 474, 476, 478 to 481 and 490 etc. A document sensor 421 at the DFU 401 is connected to an input terminal, and a document feeding motor 441 is connected to an output terminal through the driver respectively. The extended IC 262 incorporated in the other DFU 402 and the DFU 403 are connected entirely in the same manner.

The signal bus 270 is also extensible through a connector portion C2 is the same way as the bus 260 aforementioned. The connector portion C2 comprises a connector 551*c* and a connector 552*c* shown in FIG. 3. To the signal bus 270, input/output extended ICs 271, 272 . . . incorporated in the respective document discharge units are connected in parallel. The extended IC 271 incorporated in the DDU 501 is connected in principle with a solenoid for operating a document sensor 521 and a document transport passage selection claw 531, and also the display 571 (or 572 to 575) of each DDU 501 (or 502 to 505) shown in FIG. 3.

The extended ICs of the other DDU 502, 503 . . . are also connected in the same manner.

FIG. 6(*c*) shows a block diagram of the fourth CPU 280 for controlling the first and second sorters.

To an input port of the fourth CPU 280, the sensors 612 and 662 for detecting the copied paper to be introduced into the first and second sorters 600, 650, the sensors 611, 661 for detecting the copied paper to be transported to the nonsorting tray, namely, the bridge 700 or the paper discharge portion 702 or the paper discharge tray 750, and the sensors 610 and 660 for detecting the copied paper to be sent out to the sorting tray, namely, the bins 620 or 670 are connected, and to an output port thereof, the solenoid etc. for operating the sorting motors 601, 651 and selection claws 603, 653 and 703 are connected.

Figure 9:
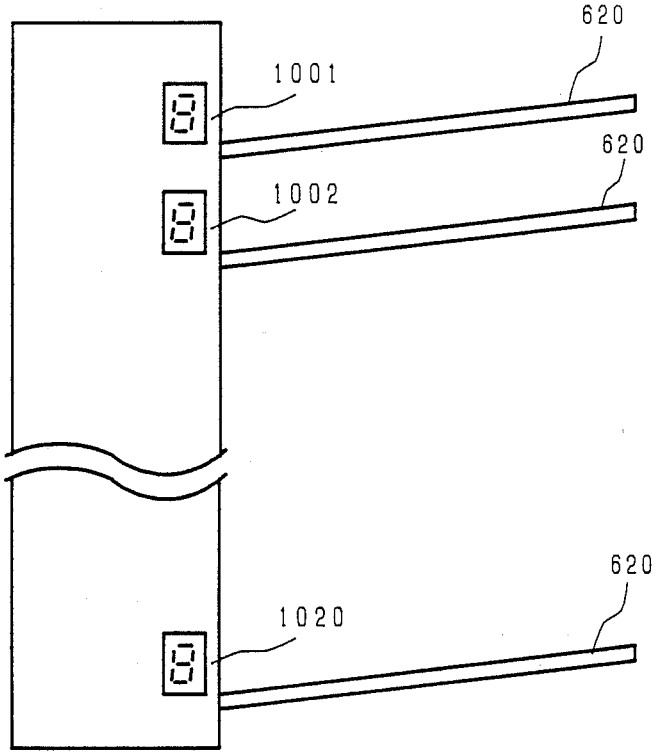
FIG. 9 is schematic view showing data displays disposed at each bin of the sorters.

The fourth CPU 280, also, is connected to data displays 1001 to 1040 through a driver 1000. As shown in FIG. 9, the data displays 1001 to 1020 are provided corresponding to each bins 650 of the first sorter 600 respectively and the data displays 1021 to 1040 are provided corresponding to each bins 670 of the second sorter 650 respectively.

The third CPU 253 and fourth CPU 280 are designed to make communication with the first CPU 201 through the buses 275 and 285.

FIG. 7 shows a RAM map defining memory areas of a RAM incorporated in the third CPU 253. In this RAM map, numerals in each row correspond to unit numbers of each DFU, and numerals in each column correspond to various parameters such as existence of a document, a state in copying operation or not, a sequence number of copying operation, the number of copies, a discharge unit number, a job mode, the number of document sheets and a sorting mode. A section defined by an intersection of a row and a column has a length of one byte.

Significations of each parameter are as follows.

In the column "existence of document", "1" indicates the presence of a document and "0" indicates the absence thereof.

In the column "under copying", "1" indicates that the document group concerned is being copied and "0" indicates that there is no document to be copied.

The column "sequence number" indicates the sequence number of the document group of the DFU to be copied.

The column "number of copies" indicates the number of copies for one sheet of a document group.

The column "discharge unit number" indicates the number of a DDU to which the document fed from the DFU is discharged.

The DDU is made to correspond, in advance, to a DFU with a one-to-one relation.

The column "job mode" indicates the mode number shown in FIG. 5, and "0" indicates the state where the job mode is not set.

The column "number of document sheets" indicates the number of document sheets set in respective DFUs.

The column "reservation number" is the number indicating the sequence number to be copied of the document group with respect to other document groups.

The column "sorter mode" is the number indicating the sorter processing mode for the copied paper whereon the document group is copied, and "1", "2" and "3" correspond respectively to the sorting mode, grouping mode and non-sorting mode.

Figure 8:
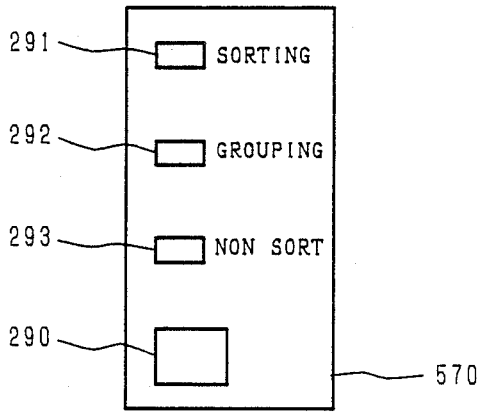
FIG. 8 is layout views of a switching panel of sorter.

FIG. 8 is a schematic diagram showing a configuration of a mode change-over panel 570 provided in each of both sorters 600 and 650.

By depressing a change-over key 290, the sorting mode, the grouping mode and the non-sorting mode are sequentially change-over to be set. The mode set at that time is the sorting mode, the grouping mode or the non-sorting mode is displayed respectively by lighting of an indicator lamp 291, an indicator lamp 292 or an indicator lamp 293 in a sequentially change-over manner.

FIG. 9 shows data displays 1001 through 1020 provided at each bin 620 of the first sorter 600. The second sorter 650 is also provided with similar data displays 1021 through 1040. As shown in the above-described FIG. 6(*c*), these data displays 1001 through 1020 and 1021 through 1040 are connected to the fourth CPU 280 through a driver 1000.

In the following, control procedures of the first CPU 201, third CPU 253 and fourth CPU 280 will be explained on the basis of flow charts in FIG. 10 onward.

Before explaining the flow charts, terminologies ON-EDGE and OFF-EDGE will be defined as follows. ON-EDGE is defined as the change of state in which states of switches, sensors, signals etc. have changed from the OFF state to the ON state.

While, OFF-EDGE is defined as the change of state in which states of switches, sensors, signals etc. have changed from the ON state to the OFF state.

Figure 10:
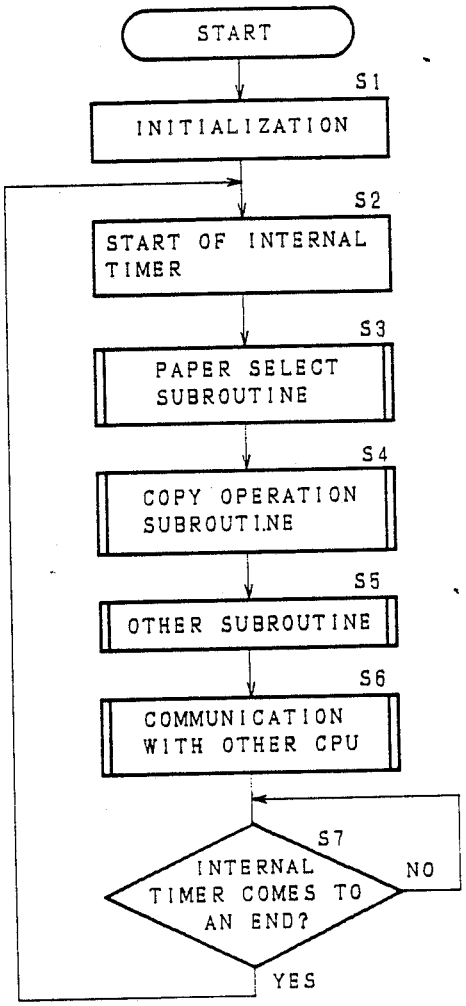
FIGS. 10 to 37 are flow charts showing control procedures of the CPU. DESCRIPTION OF THE PREFERRED EMBODIMENTS In the following, the present invention will be specifically described with reference to the drawings showing the embodiments.

FIG. 10 shows a main routine of the first CPU 201.

When the power source is applied and the first CPU 201 is reset to start the program. First, the first CPU 201 makes initialization in Step S1 to clear the RAM and to set the contents of various registers to initial values and respective devices to initial modes.

Then, in Step S2, the first CPU 201 starts an internal timer. The internal timer decides the required time for one routine in the main routine independently of the processing content in respective subroutines to be described in the following, and its value is set, in advance, at initial setting in Step S1.

Next, the first CPU 201 calls subroutines shown in Steps S3 to S6 successively. When all the subroutines are processed, the first CPU 201 waits for an end of the internal timer in Step S7 and returns to Step S2. The first CPU 201 counts various timers used in respective subroutines by using the length of the period of one routine.

After having called all of the subroutines related to operations of the present apparatus, the first CPU 201 makes data communication with the second CPU 202, third CPU 253 and fourth CPU 280 in Step S6.

Figure 11:
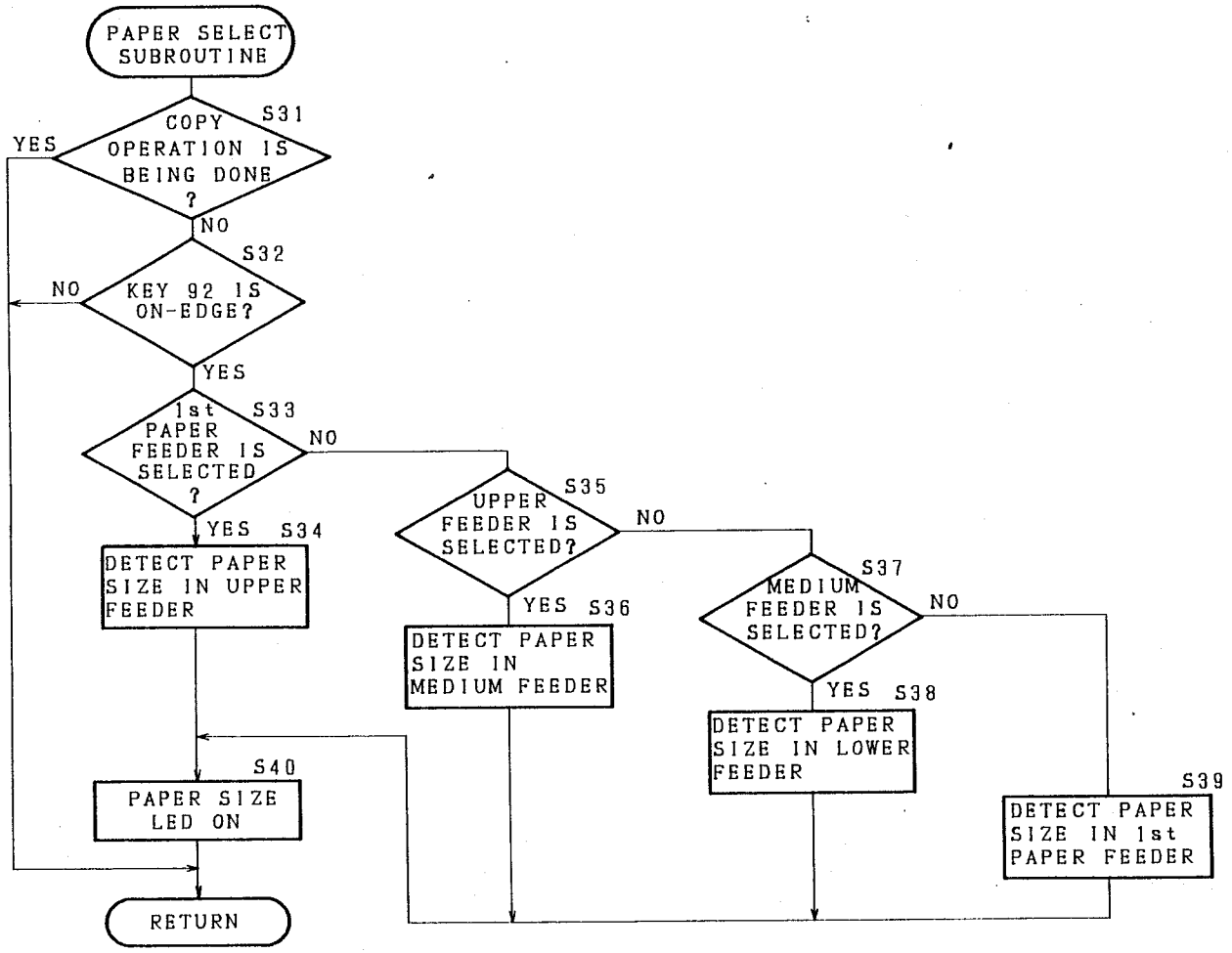

FIG. 11 shows a paper select routine in Step S3.

When ON-EDGE of the paper select key 92 is detected when copying is not being done (Steps S31, S32), the first CPU 201 selects an upper stage paper feed portion of the three-stage paper feed unit 19 if the first paper feed (on the side of the cassette 18) is selected at present, selects a medium stage paper feed portion if the upper stage paper feed portion of the three-stage paper feed unit 19 is selected, selects the lower stage paper feed portion if the medium stage paper feed portion is selected, and selects the first paper feed if the medium stage paper feed portion of the three-stage paper feed unit 19 is selected, to detect the paper size being mounted by the size detecting switches disposed on respective paper feed portions (Steps S33 to S39), and to turn ON LEDs 92*a* to 92*d* for the detected paper sizes (Step S40).

When the cassette is mounted on the second paper inlet in place of the three-stage paper feed unit 19, the upper and lower paper inlets are selected alternately by the same processings.

Figure 12:
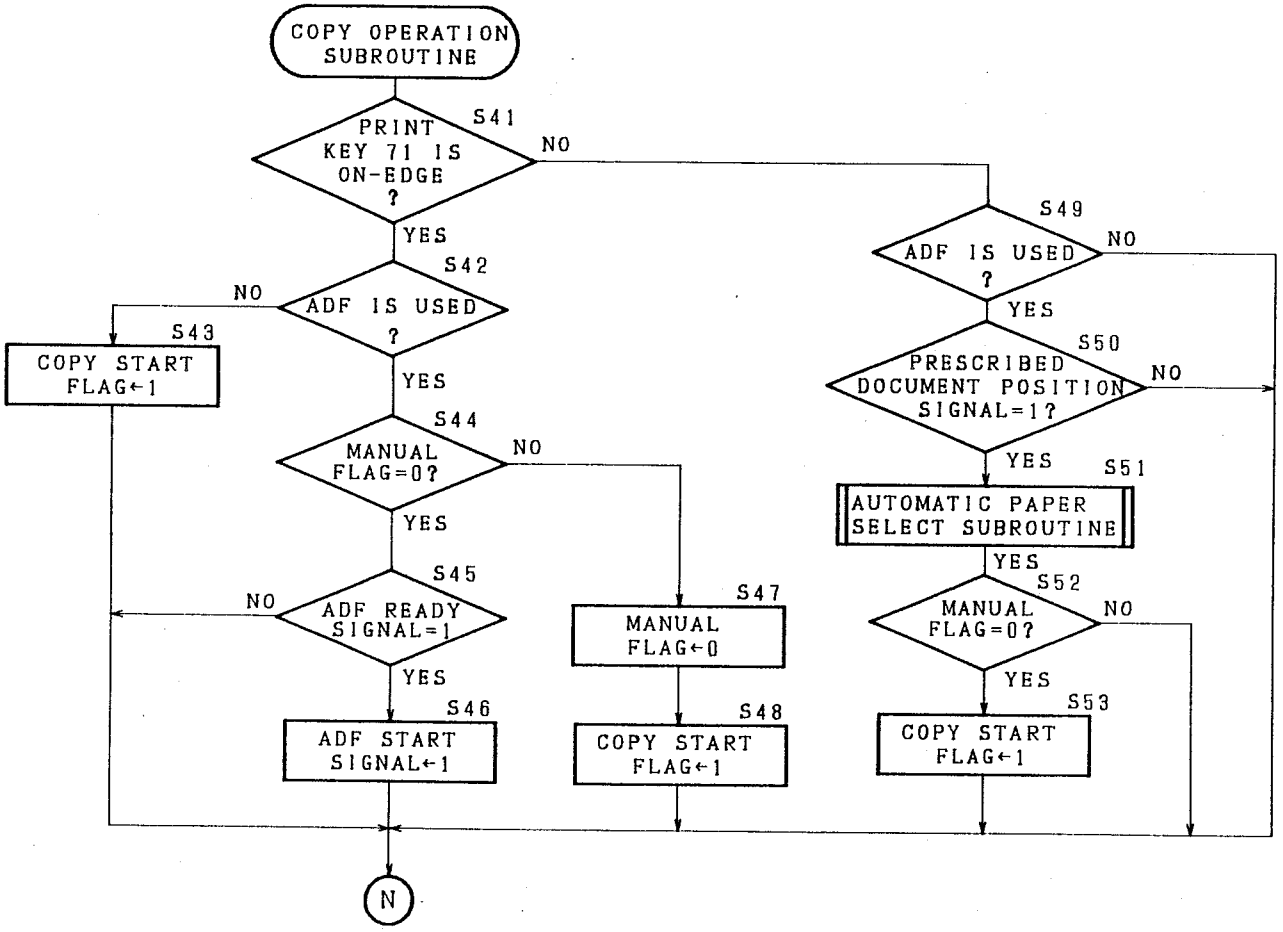
Figure 13A:
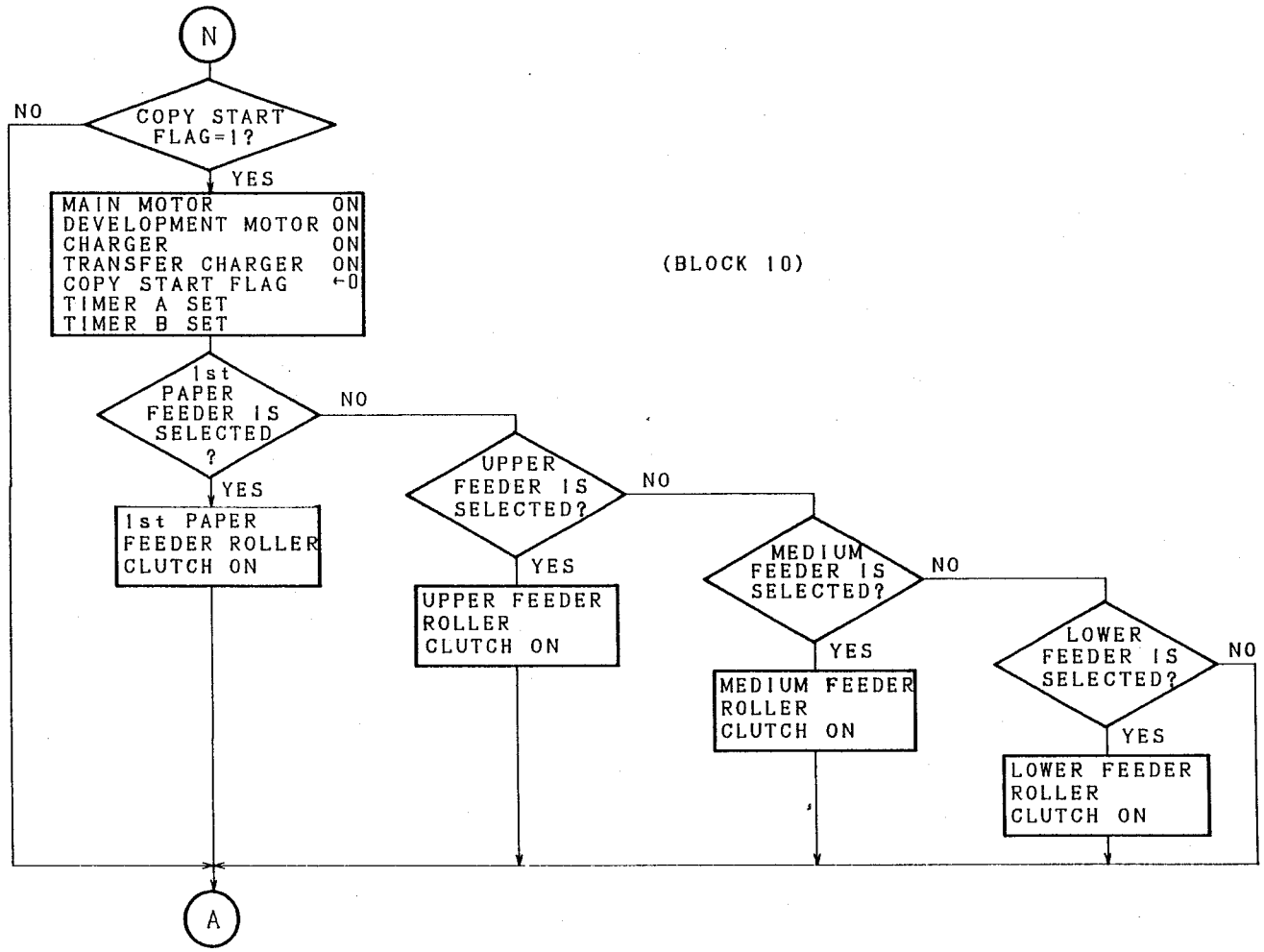
Figure 13B:
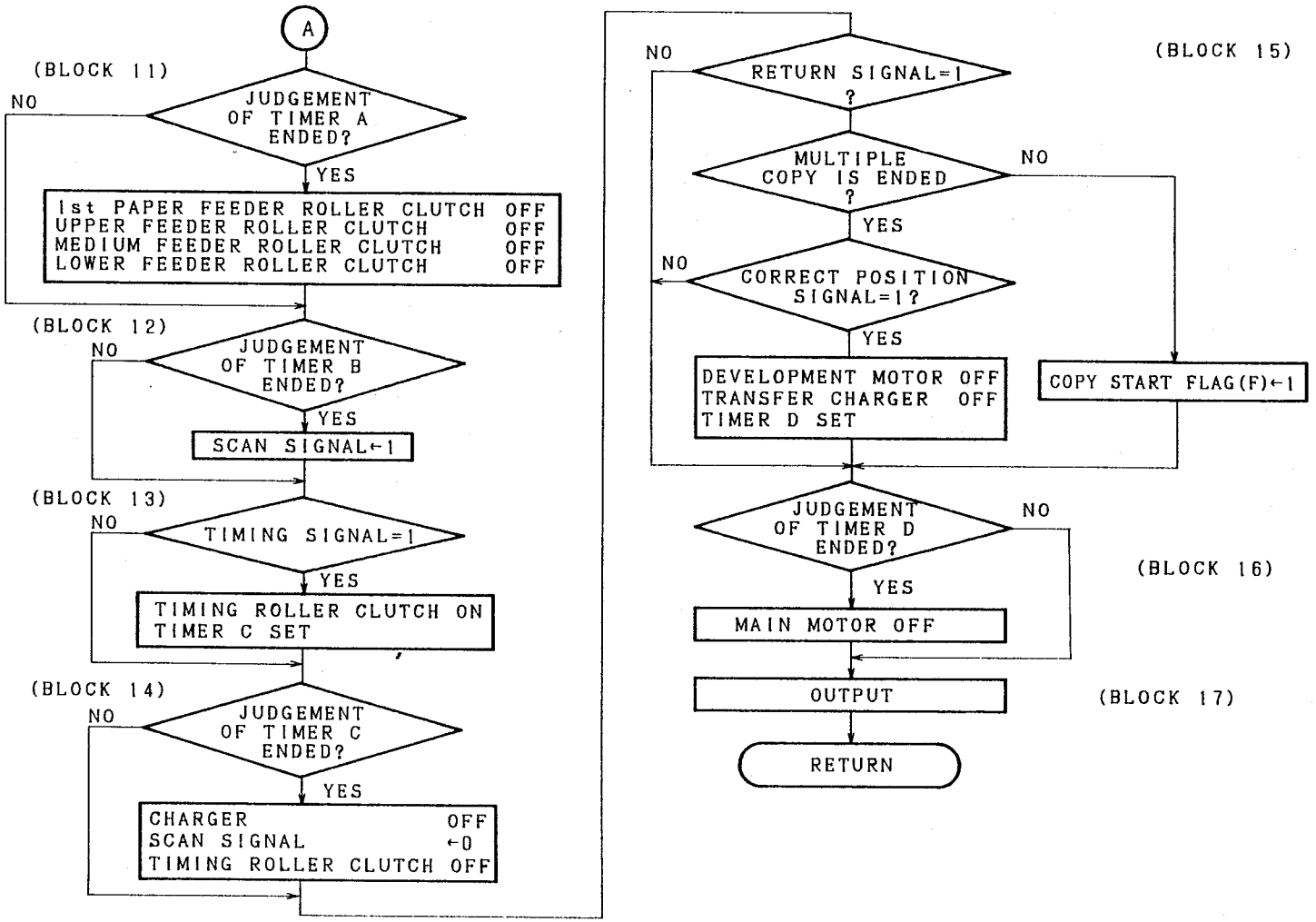

FIGS. 12 and 13(*a*), 13(*b*) show details of a copying operation routine.

At ON-EDGE of the print key 71 in Step S41, when an ADF is not installed, the first CPU 201 immediately sets a copy start flag to "1" (Step S43). If the ADF is used, the first CPU 201 determines the ADF ready signal from the ADF when a manual flag is "0". If the manual flag is "1", the first CPU 201 sets the ADF start signal to "1" (Steps S44 to S46). The manual flag is set when suitable paper can not be found by an automatic paper selection APS.

On the other hand, if the manual flag is "1", the first CPU 201 results the manual flag to "0" by turning ON the print key 71 and sets the copy start flag to "1" (Steps S47, S48).

When the print key 71 is not ON-EDGE and the ADF is used, the first CPU 201 judges a prescribed document position signal from the ADF in Step S50, and when the signal becomes "1", the first CPU 201 searches for a cassette containing paper of a suitable size in the automatic paper select routine (Step S51). If paper of a suitable size is found by the search (manual flag="0"), the first CPU 201 sets the copy start flag to "1" (Step S53).

Then, in FIGS. 13(*a*) and 13(*b*), the first CPU 201 first judges the copy start flag. When the result is "1", the first CPU 201 turns ON the main motor, development motor, charger 3 and transfer charger 5, and at the same time, turns ON the roller clutch CL at the selected paper inlet, returning the copy start flag to "0", and sets a timer A(T-A) and a timer B(T-B) respectively (Block 10).

The timer A controls the ON time of the clutch of paper feed roller of either the paper feed roller 20 or the three-stage paper feed unit. The timer B controls the start of scanning.

In Block 11, the first CPU 201 determines the timer A and turns OFF the paper feed roller clutch at its time-up.

In Block 12, the first CPU 201 judges the timer B and sets the scan signal to "1" at its time-up.

In Block 13, the first CPU 201 turns ON the clutch of the timing roller 22 and sets a timer C(T-C) when the timing signal becomes "1". The timer C controls operation of the timing roller 22.

In Block 14, the first CPU 201 judges completion of the timer C and turns OFF the charger 3, scan signal and timing roller clutch at its time-up.

In Block 15, the first CPU 201 judges the state "1" of a return signal emitted when the first slider tries to return to a home position. When the return signal becomes "1", the first CPU 201 judges whether or not copying operation for multiple copying is completed, if it is not completed, the first CPU 201 sets again the copy start flag to "1". If the copying operation is completed, the first CPU 201 waits for the prescribed position signal emitted when the first slider returns to the home position, then turns OFF the development motor and transfer charger 5 and sets a timer D(T-D).

In Block 16, the first CPU 201 judges an end of the timer D and turns OFF the main motor at its time-up. In the final Block 17, the first CPU 201 outputs a logical signal for real operation.

Figure 14:
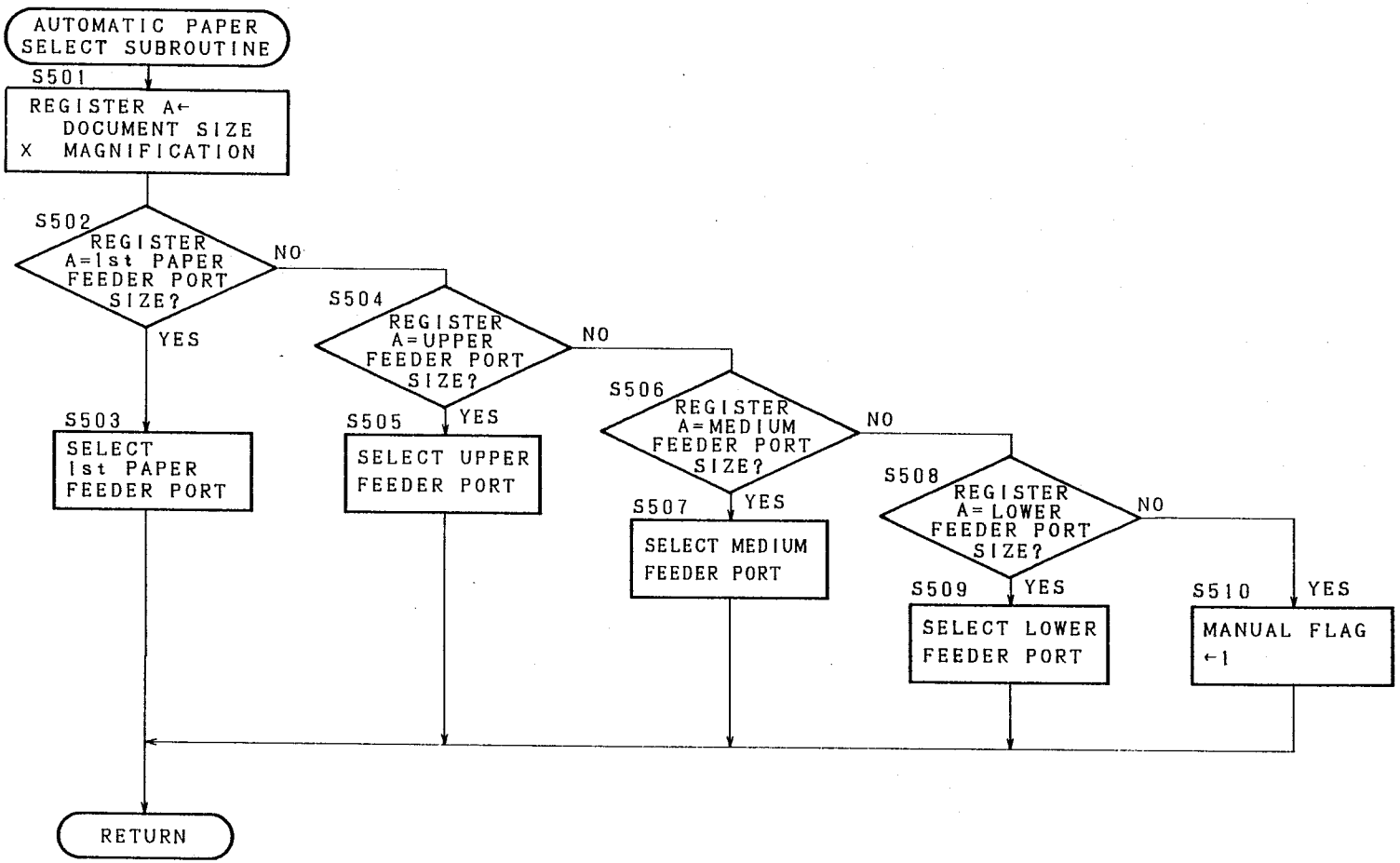

FIG. 14 shows a flow chart of the automatic paper select routine in the copying operation routines aforementioned.

In Step S501, the first CPU 201 stores a result of multiplication of the document size and the magnification in a register A. Then, the first CPU 201 compares the content of the register A and the real size data of the paper size in the upper paper inlet and the paper inlet of the three-stage paper feed unit to select the paper inlet if it is appropriate (Steps S502 to S509). If it is not appropriate, the first CPU 201 sets the manual flag in Step S510 and returns to the main routine.

Figure 15:
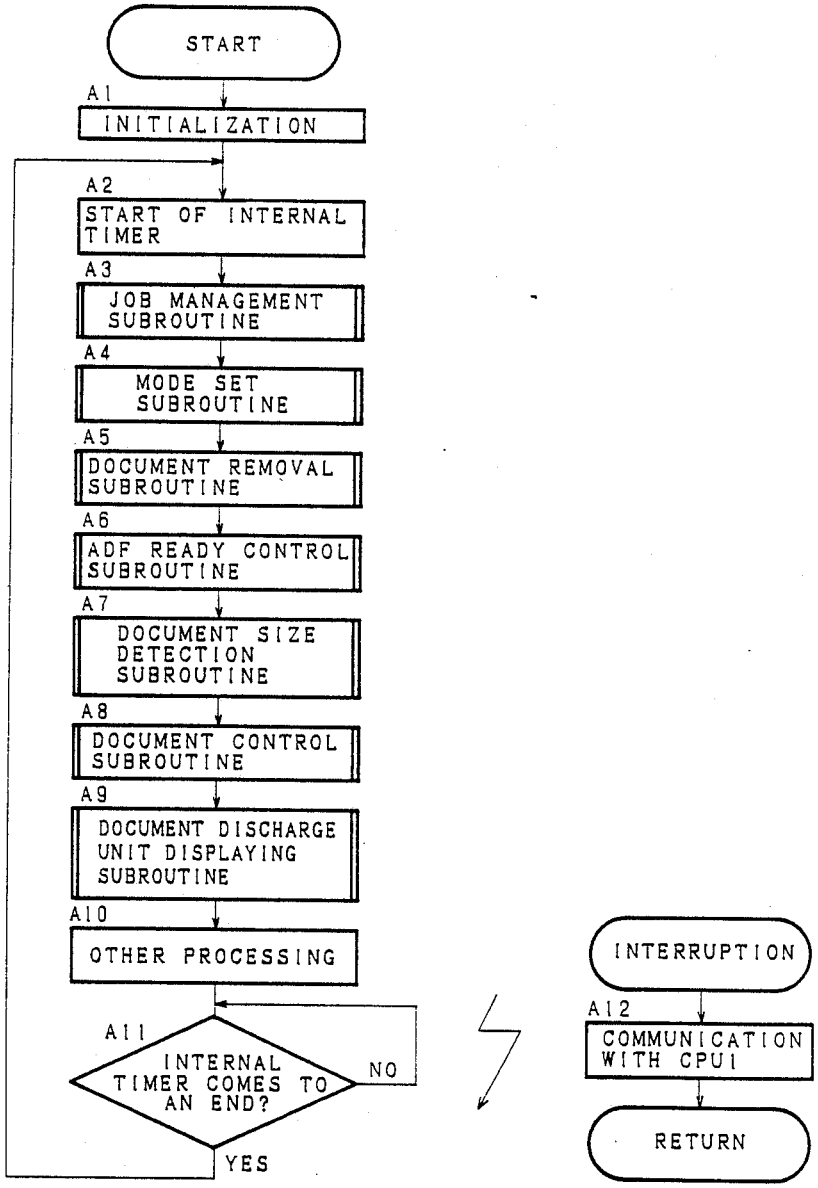

FIG. 15 is a general flow chart of a program of a third CPU 253 controlling operation of the ADF.

When the program starts, the third CPU 253 performs initial setting in Step A1 to clear the incorporated RAM and to set the contents of various registers.

Then, the third CPU 253 starts the internal timer and calls successively the subroutines (Steps A3 to A10) shown in the flow chart.

The third CPU 253 judges completion of the internal timer in the final Step A11 and when the internal timer is completed, it starts the timer again (Step A2) and executes the loop repeatedly.

Data communication between the third CPU 253 and the first CPU 201 is made by an interrupt routine according to an interrupt request INT from the first CPU 201 at the step A12 independently of the main routine.

Figure 16A:
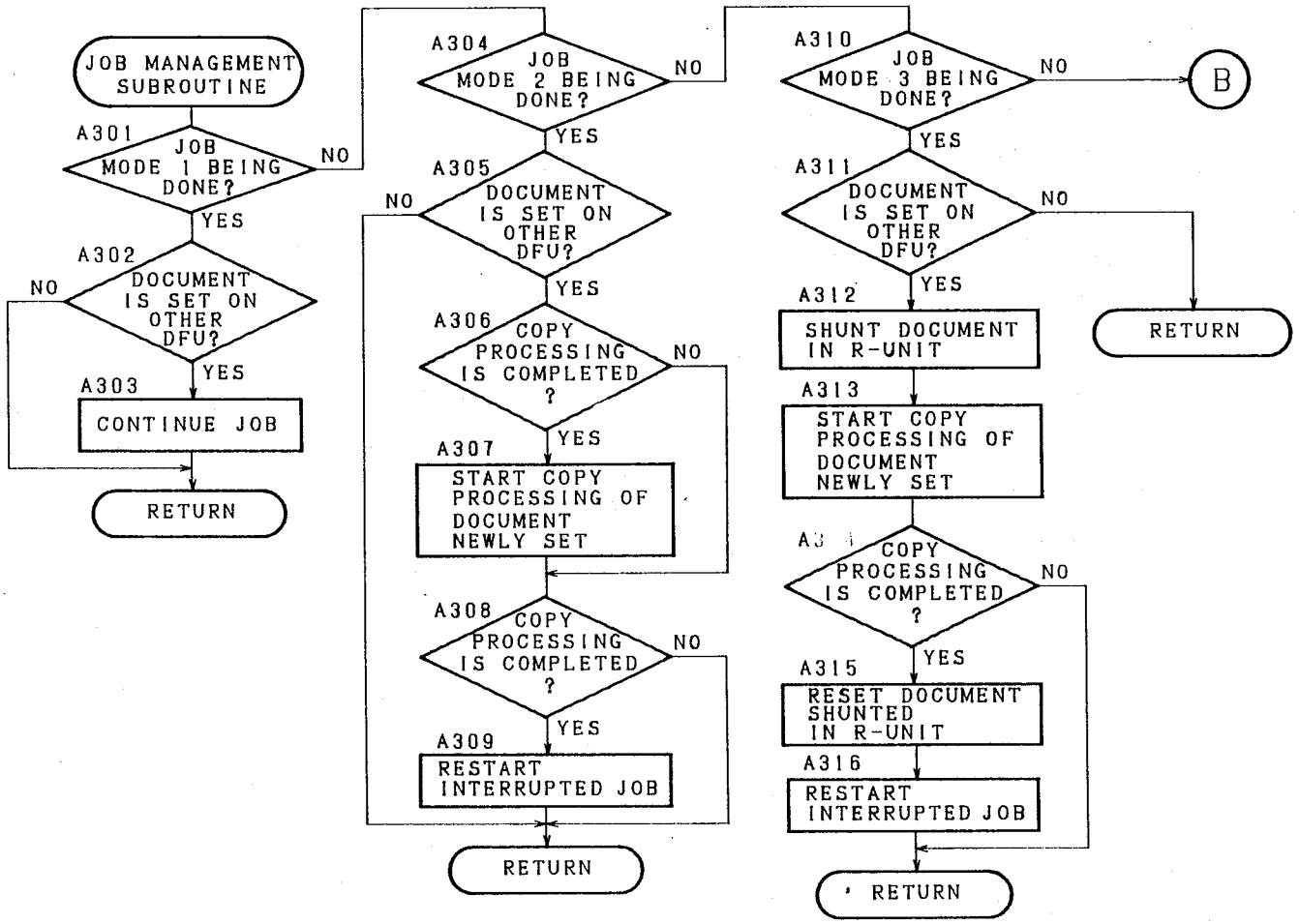
Figure 16B:
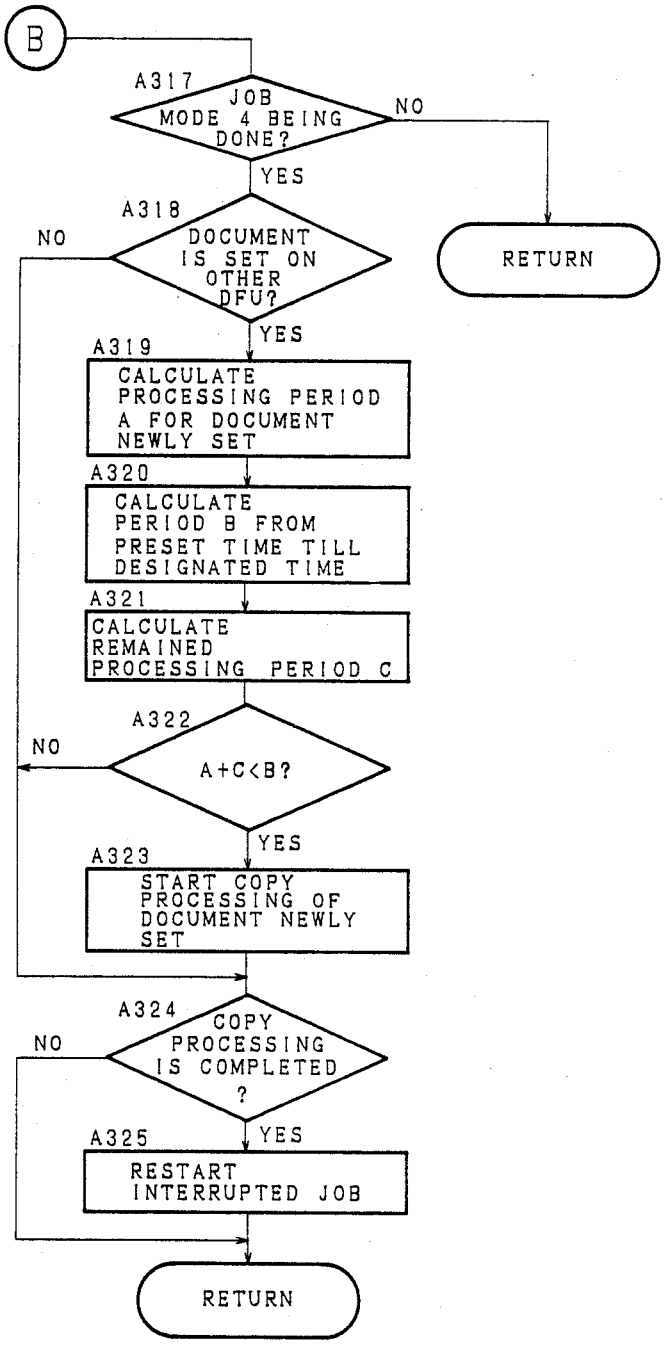

FIG. 16 shows a job control routine in Step A3. First, in Steps A301, A304, A310 and A317, the third CPU 253 judges whether or not any of the DFUs is operating in any of the job modes 1 to 4.

When documents are set in the other DFU while a certain DFU is executing the job in the job mode 1, the third CPU 253 continues the job being executed, or completes its own processing neglecting the document newly set (Steps A302, A303).

When the job in the job mode 2 is being executed, the third CPU 253 judges whether or not copying of a predetermined number of copies for a sheet of document being copied at that point of time is completed. When it is not completed, the third CPU 253 completes the predetermined number of copies and thereafter interrupts the job in the job mode 2 and starts copying documents newly set in the other DFU, and when the new job is completed, again starts the job which has been interrupted (Steps A304 to A309).

When the job in the job mode 3 is being executed, the third CPU 253 interrupts the job after completing copying of one copy for a sheet of document being copied at that point of time, and shunts the document in the R unit 350 (Steps A310 to A312).

Then, the third CPU 253 starts copying documents newly set and when the new job is completed, resets the document shunted in the R unit 350 on the document table 35 and restarts the job which has been interrupted (Steps A313 to A316).

When the job in the job mode 4 is being executed, first, the third CPU 253 calculates the processing period A for documents newly set in the other DFU, on the basis of the number of document sheets set on the operation panel of the DFU (Steps A317 to A319). Then, the third CPU 253 calculates the period B from the present time till the designated time and the remained processing period C of the job (Steps A320, A321). In Step A322, the third CPU 253 judges whether or not $A+C<B$, namely, processing for documents newly set can be received and the job being executed at present can be completed till the designated time. When it is possible, the third CPU 253 interrupts the job being executed and starts copying for the documents newly set (Step A323). When this is completed, the job being interrupted is restarted (Steps A324, A325).

Figure 17:
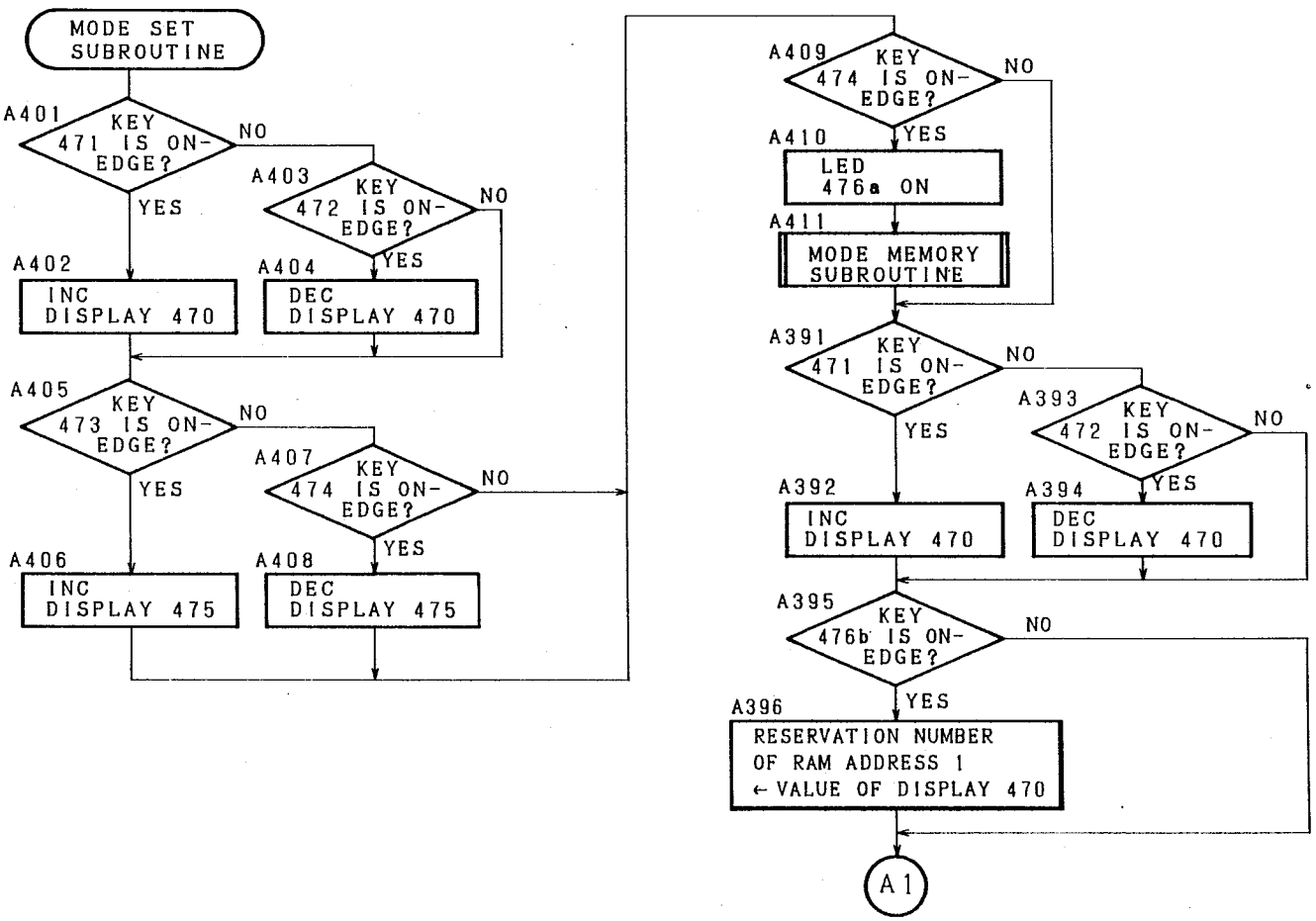
Figure 18:
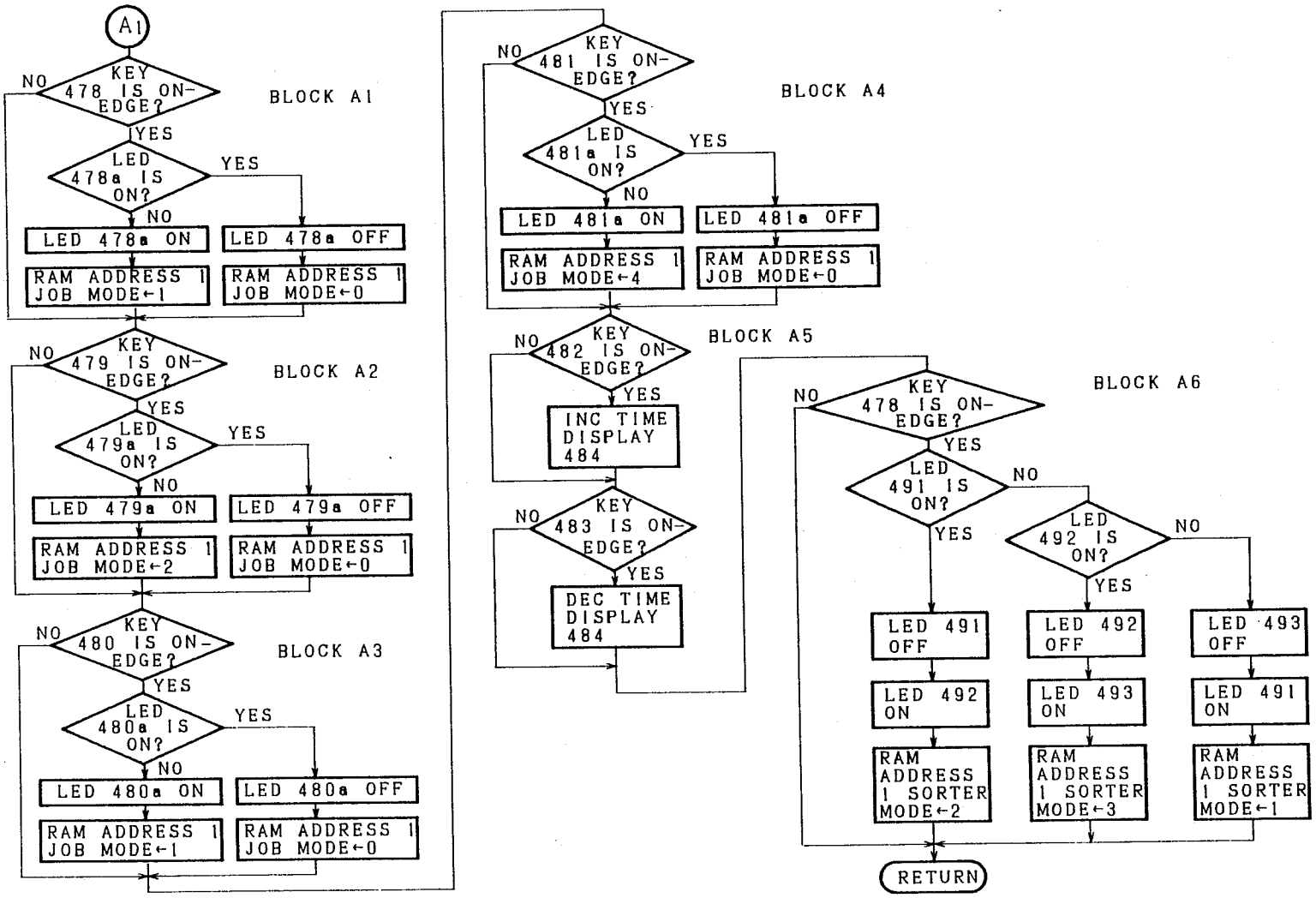

FIGS. 17 and 18 show the mode set routine of Step A4 for setting the aforesaid job mode and sorter mode, in which processings for defining memory areas in the RAM map shown in FIG. 7 by data based on input operation and calculation are shown.

First, in Step A401 or Step A403, displayed numeral of the number of copies on the display 470 is incremented (or decremented) by ON-EDGE of the key 471 (or 472) (Step A402 or A404). Then, by Steps A405 to A408, displayed numeral of the number of document sheets on the display 475 is similarly incremented (or decremented). The third CPU 253 turns ON the display (LED) **476*a* by ON-EDGE of the set key 476 (Step A409 and A410) and executes a mode memory routine (Step A411**).

Next, the third CPU 253 increments the display value of the display 470 (in this case, it is display of reservation number) by the ONE-EDGE of the key 471 (or 472) at the step A391 or the step A393. Thereafter, the third CPU 253 writes the value of display 470 as the reservation number into the RAM address 1 by ONE-EDGE of the reservation number registering key **476*b* (steps A395, A396**).

The job mode and sorter mode are selected and set by Blocks A1 to A6 shown in FIG. 18.

First, when the LED **478*a* (or 479*a*, 480*a*, 481*a*) is OFF by ON-EDGE of the key 478 (or 479, 480, 481), the third CPU 253 turns it ON and sets the job mode of a RAM address 1** to "1" (or "2", "3", "4").

Here, the case where a document is set in the DFU 401 is shown as an example, and the RAM address N (="1") corresponds to the DFU number N (="1").

On the other hand, when the LED **478*a* (or 479*a*, 480*a*, 481*a*) is ON, the third CPU 253 turns it OFF and sets the job mode of the RAM address 1 to 0** or releases setting of the job.

In Block A5, the displayed time on the display 484 is upped (or downed) by ON-EDGE of the key 482 (or 483) and the copying completion time is set.

In the next Block A6, the third CPU 253 sets the sorter mode. When the LED 491 is ON by ON-EDGE of the key 490, the third CPU 253 turns it OFF and turns ON the LED 492, setting the sorter mode of the RAM address 1 to 2 or setting to the grouping mode, and when the LED 492 is ON, the third CPU 253 turns it OFF and turns ON the LED 493, setting the sorter mode to 3 or to the non-sorting mode. When the LED 493 is ON, the third CPU 253 turns it OFF and turns ON the LED 491, setting the sorter mode to 1 or to the sorting mode.

Figure 19:
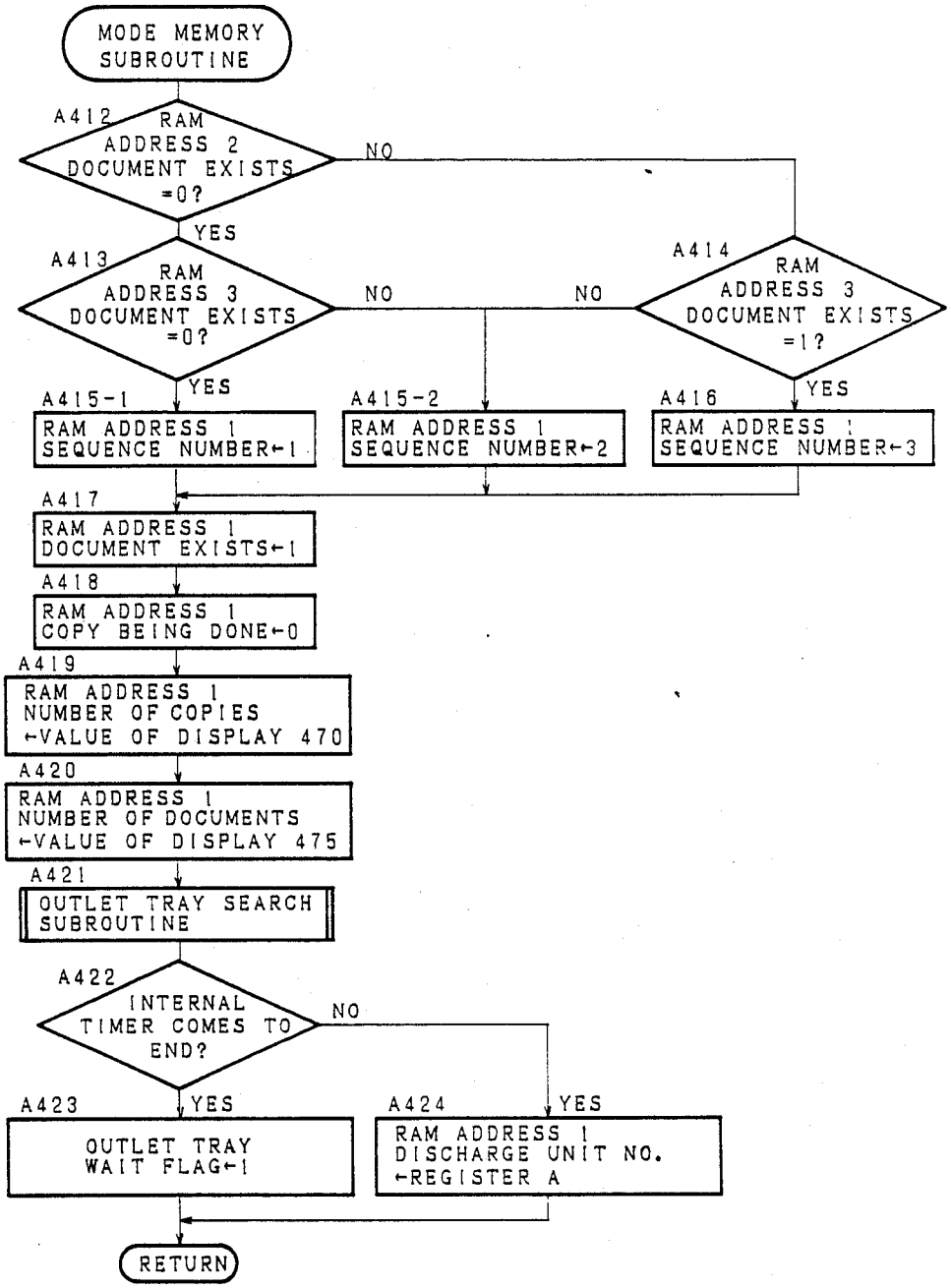

FIG. 19 shows the mode memory routine.

First, in Steps A412 to A416, by whether or not a document is set in the other DFUs 402, 403, the sequence number of copying of the document is decided.

That is, the third CPU 253 checks data of the "document existence" area of the RAM addresses 2 and 3, and if they are "0" "0", sets "1" if they are "0" "1", sets "2" and if they are "1" "1", sets "3" in the "sequence number" area of N="1". That is, in the present embodiment, the copying sequence usually corresponds to setting order of the documents.

When the sequence number is set, the third CPU 253 sets "1" in the "document existence", "0" "during copying", the numeral of display 470 in the area of the "number of copies" and the numeral of display 475 in the area of the "number of document sheets" respectively (Steps A417 to A420). Then, the third CPU 253 calls a discharge tray search routine shown in FIG. 20 to decide discharging end of the document, and stores the value of the register A in the discharge unit number area of the RAM address 1. If the register A is "0" or the documents exist in every discharge unit trays, the third CPU 253 sets the discharge tray wait flag to "1" (Steps A421 to A424).

Figure 20:
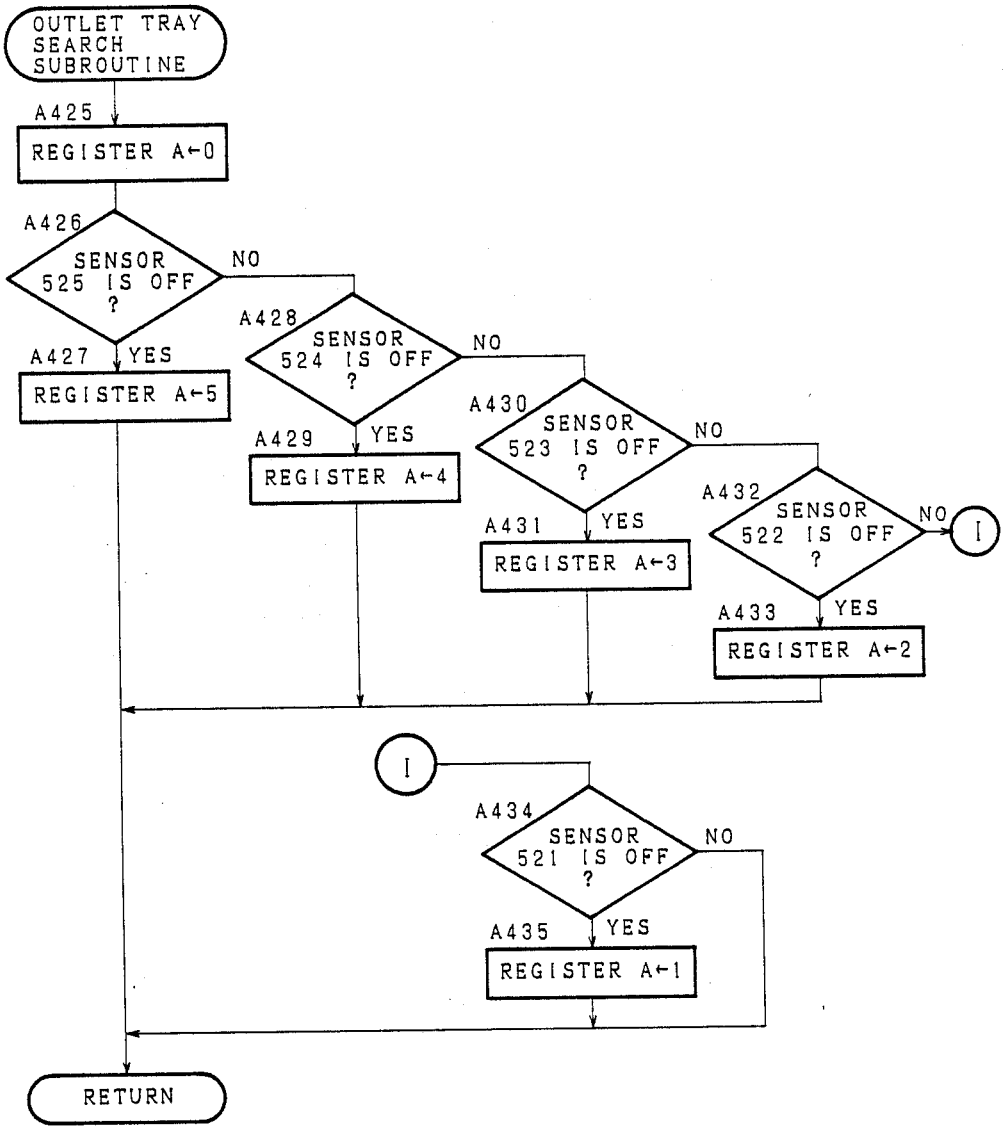

FIG. 20 shows a discharge tray search routine.

First, the third CPU 253 resets the register A in Step A425 and sets values 5, 4 . . . 1 in the register A by OFF of the document existence sensors 525, 524 . . . , 521 of the discharge tray or by absence of the document (Steps A426 to A435). As can be seen from this flow chart, the discharge trays are allocated automatically in a preferential basis succesively from the top to the bottom. This is because that, as same as the sorter according to the subject matter of the present invention, the higher the document is placed, the easier the removal thereof by the user.

When processing of the mode set routine in Step A4 (FIG. 17 and FIG. 18) in FIG. 15 is completed as aforementioned, the third CPU 253 then calls a document removal routine in Step A5.

In this routine, when the document set is removed on the way for some reason, for example, the sequence number of the document coming later than the sequence number of the document removed is automatically moved up, thereby it is made possible to prevent a loss of time caused by processing judgment for the removed document.

Figure 21:
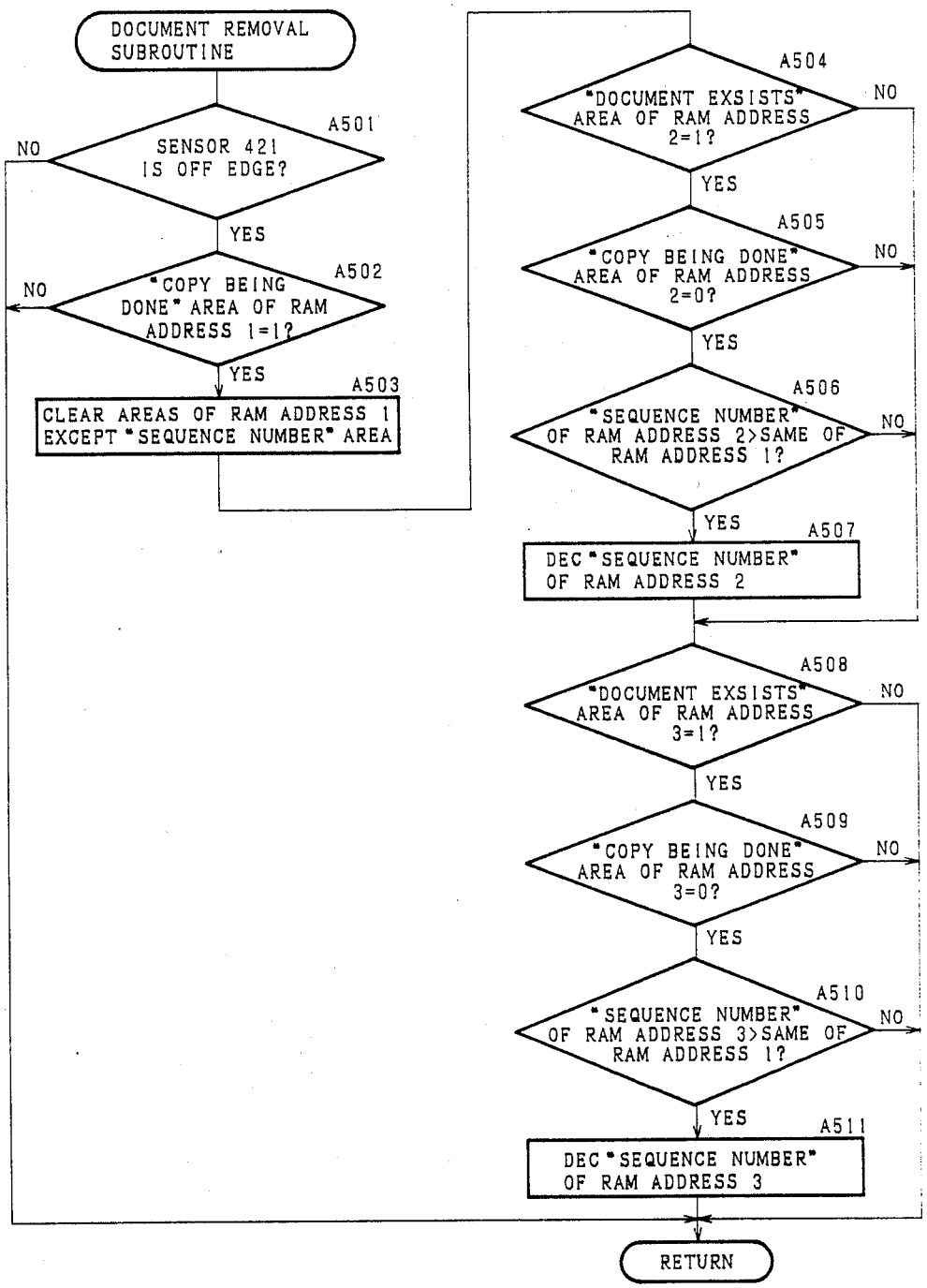

FIG. 21 is a flow chart showing details of a document removal routine.

For example, in case where, out of three document feed units (DFUs) 401 through 403, a document detecting sensor 421 of the DFU 401 is turned off by removal of documents, by OFF-EDGE of the sensor 421 (step A501), the third CPU 253 checks an address 1 of the RAM area as shown in FIG. 7, that is, a parameter of "copy being done" among information on the document loaded in the DFU feed unit 401 (step A502). If this result is "0", that is, not "copy being done", the third CPU 253 clears all other than the area of "sequence number" of this RAM address 1 (step A503). Subsequently, the third CPU 253 checks each area of "document exists" in a sequence of RAM addresses 2 and 3 (steps A504 and A508), and if this result is "1", that is, the state that a document exists, it checks the area of "copy being done" (steps A505 and A509), and if this result is "0", that is, not "copy being done", it checks whether or not the value of each area of "sequence number" is larger than the value of "sequence number" of the address 1 (steps A506 and A510), and if this check results in "larger", the value of "sequence number" area of each address is decremented by "1" (steps A508 and A511).

For the other DFUs 402 and 403, similarly, the above-described processing is performed by OFF-EDGE of each of document detecting sensors 422 and 423, and "sequence number" of each document for which a number higher than the "sequence number" set for the removed documents is incremented by "1".

Step A6 in FIG. 15 is an ADF ready control routine for informing from the ADF 300 to the present apparatus whether or not the ADF 300 itself is ready to start.

Figure 22:
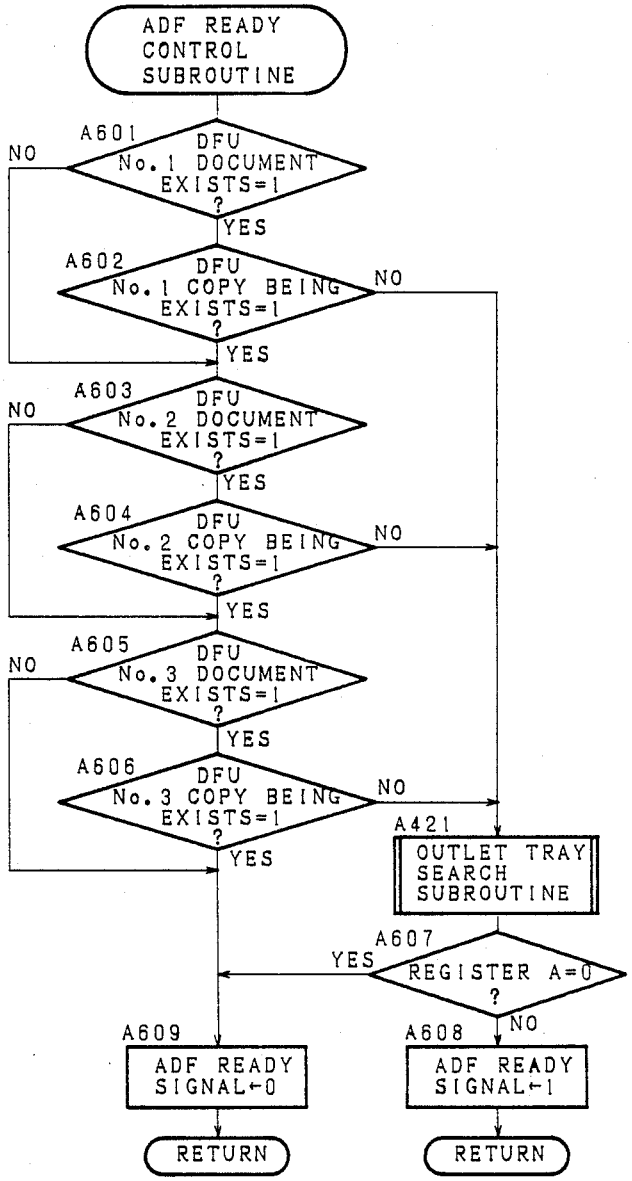

As shown in FIG. 22, if a document is set in any of the document feed trays and any of the document discharge tray is empty, the ADF is ready to start and the third CPU 253 sets the ADF ready signal to "1".

On the other hand, if the ADF 300 can not be started at present, the third CPU 253 sets the ADF ready signal to "0" (Step A609). The ADF ready signal is set to "1" only when the third CPU 253 judges whether a document exists in any of the document feed trays by "1" of "document existence" on the RAM map, and when the third CPU 253 further judges that a document does not exist in any of the discharge tray by the discharge tray search routine when the document is not being copied (not "1") (Step A608).

Step A7 in FIG. 15 is a document size detection routine, which employs an APS (Automatic Paper Selection function) or an AMS (Automatic Magnification Selection function) and is called when the document size is judged automatically. In this routine, a standard document size is judged by detecting a range to which a real size of the document belongs by using a sensor 306 and a software timer.

Figure 23:
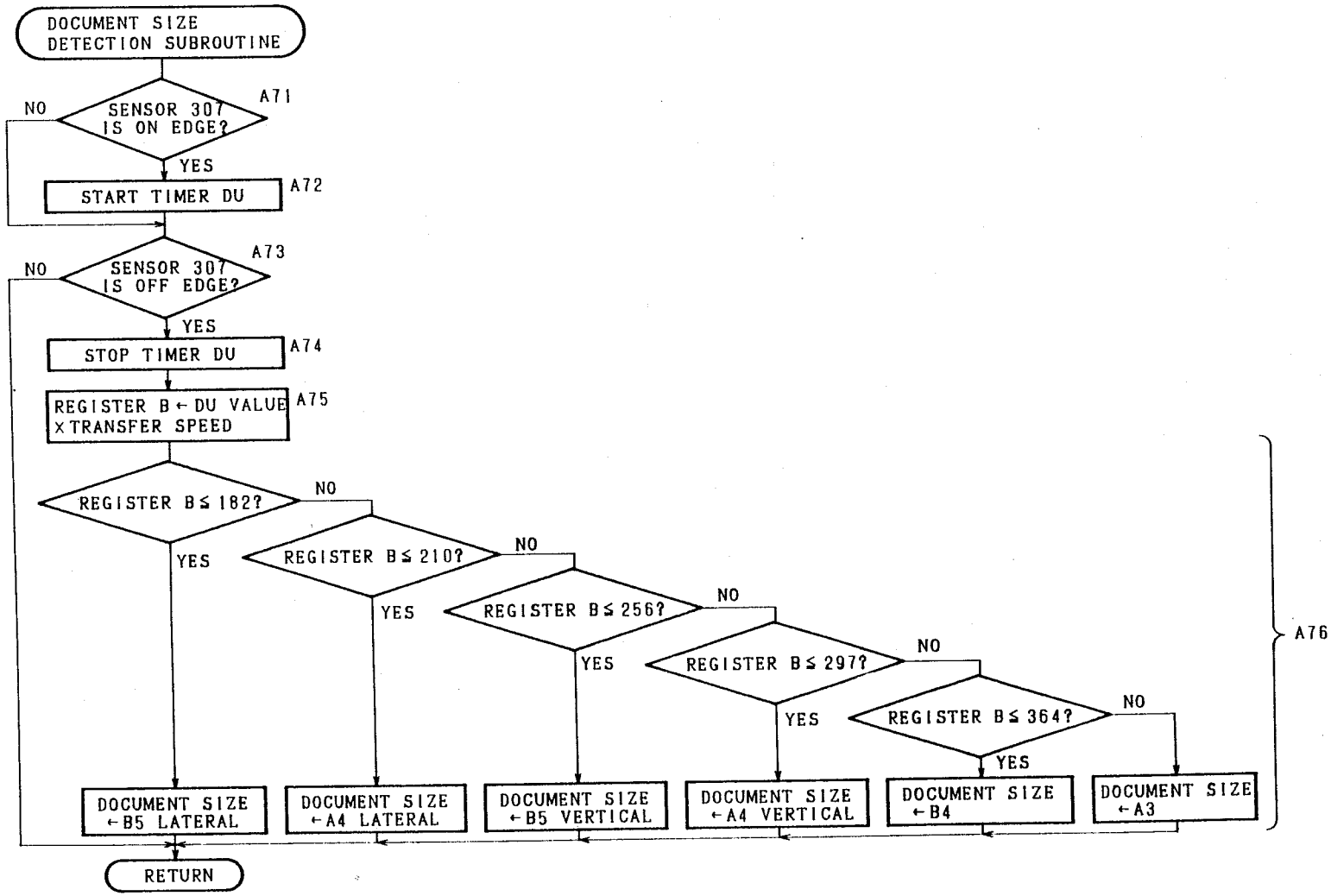

This means that, as a flow chart is shown in FIG. 23, the third CPU 253 makes a software timer DU start time-counting (step A72) by ON-EDGE of the sensor 307 which is fed at the side of the document inlet of the document feed control part 301 and detects a loading of document (step A71), and it makes the software timer DU stop time-counting (step A74) by OFF-EDGE of the same sensor (step A73). Then, the third CPU 253 calculates the length of the document by the value of time-counting of the timer DU and the feeding speed of the document (step A75), and stores it in the B register (step A75). Thereafter, the third CPU 253 judges the size of the document by comparing the value stored in the B register with the longitudinal and lateral sizes of B5 and A4 sizes in sequence (step A76).

Figure 24:
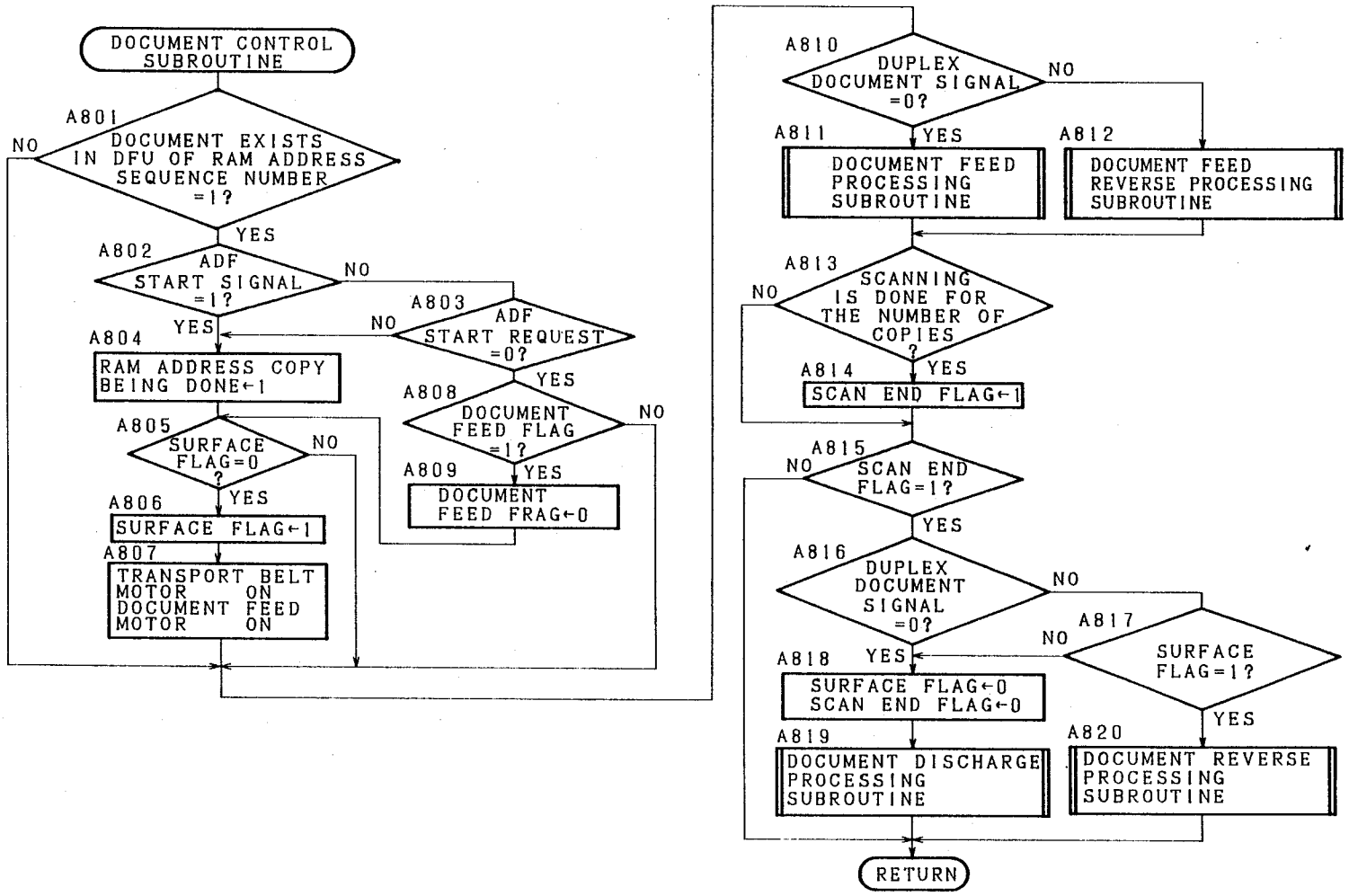

FIG. 24 shows a document control routine of Step A8 in FIG. 15.

In this routine, processings related to feeding and discharging a document are performed.

First, the third CPU 253 detects by the corresponding sensor on the operation panels 461 to 463, whether or not a document exists in the DFU whose RAM address "sequence number" is 1. If the document exists, the third CPU 253 sets "under copying" of the RAM address of the DFU whose RAM address "sequence number" is "1" to "1" (Steps A801 to A804) and judges a surface flag, when the ADF start signal from the first CPU 201 is "1" or the ADF start request is "1", namely, when any of the document discharge tray is empty and the ADF 300 can be started. When it is the mode to copy the surface of a document, the third CPU 253 sets the surface flag to "1" and turns on the transport belt motor 306 and the document feed motor of the corresponding DFU (Steps A805 to A807).

When the ADF start signal is "0" and the ADF start request is also "0" in Step A802, the third CPU 253 judges the document feed flag or a flag controlling start of feeding the documents of the second sheet onward. When the document flag is "1", the third CPU 253 resets this flag and turns ON the two motors aforementioned (Steps A803, A808, A809).

The document is then fed by the aforesaid processings and the third CPU 253 determines the both sides document signal from the first CPU 201 in Step A810, when the signal is "0", or in the case of one side copying, calls the document feed processing routine (Step A811). If the signal is "1" or in the case of two sides copying, the third CPU 253 calls the document feed reverse processing routine (Step A812).

Figure 25:
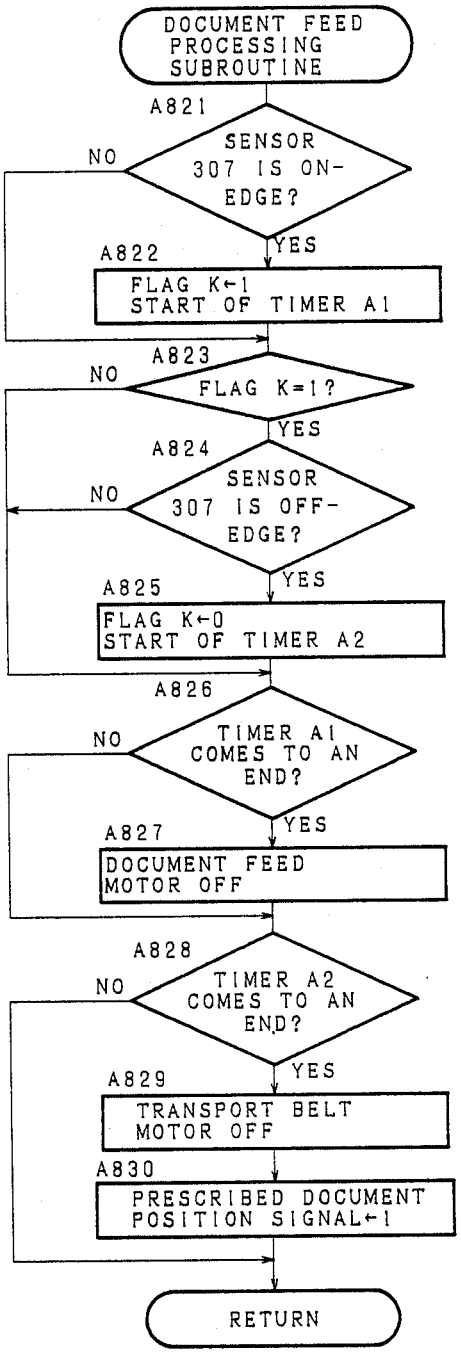

FIG. 25 shows the document feed processing routine above-mentioned.

First, when a document is fed, a sensor 307 provided at the end portion on the side of DFU 401 of the document transport control portion 301 detects it, and the third CPU 253 sets a flag K to "1" by its ON-EDGE and starts a timer A1 (Steps A821 and A822). The timer A1 is provided to turn OFF the document feed motor or to retain the next document such that it is not sent before a predetermined processing is completed, and in which the time to reach the position where the document is driven by the transport belt 305 is set.

Then, the third CPU 253 judged the flag K, if the flag is "1", it detects OFF-EDGE of the sensor 307 or the trailing edge of the document to reset the flag K and starts the timer A2 (Steps A823 to A825). In the timer A2, the time for the trailing edge of the document to reach a predetermined edge position of the document on the document table 35 is set. Then, the third CPU 253 turns OFF the document feed motor and transport belt motor 306 respectively at time-up of the timers A1 and A2, and sends the signal indicating that the document is set in a predetermined position to the first CPU 201 (Steps A826 to A830).

Figure 26:
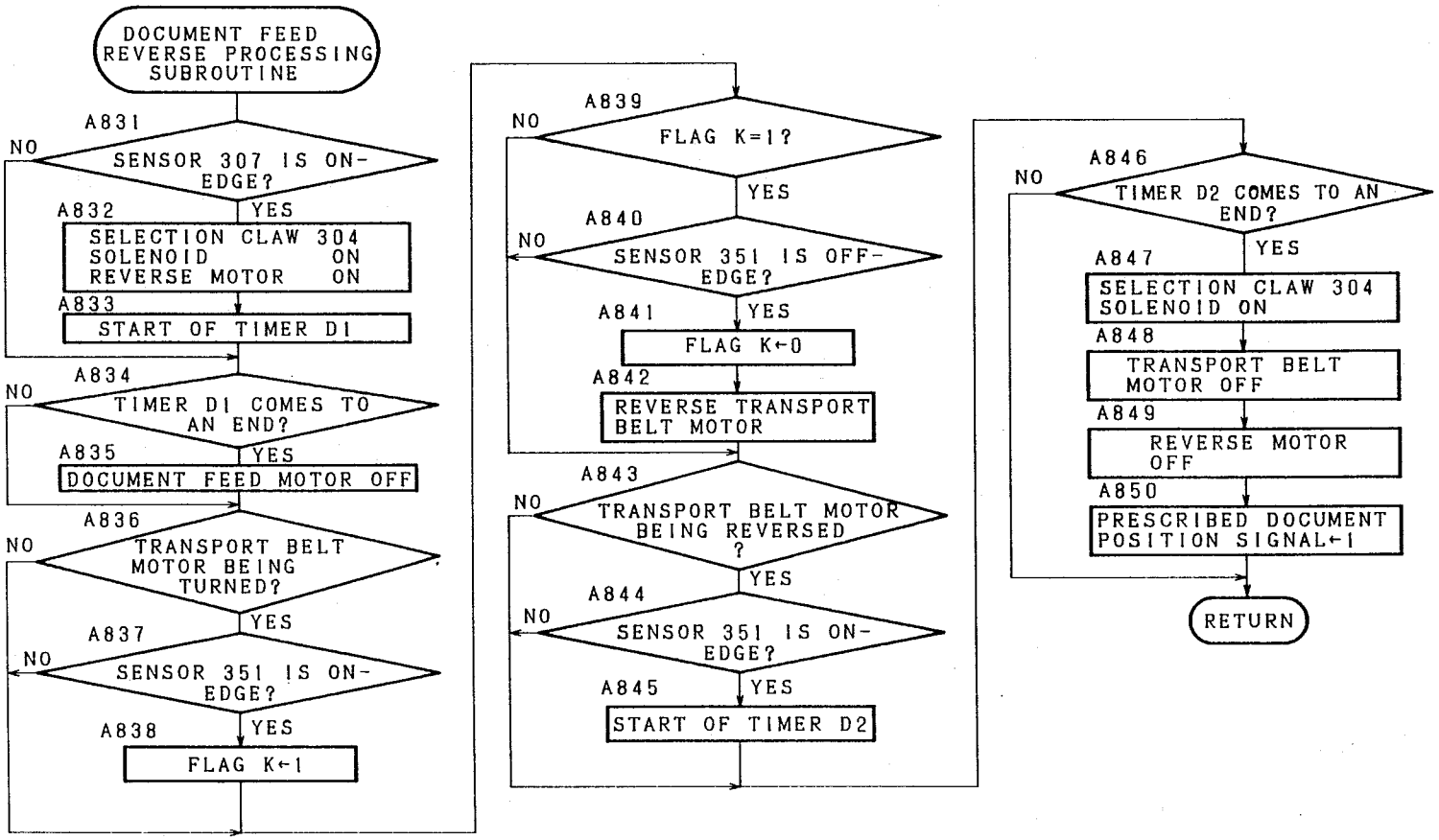

FIG. 26 shows the document feed reverse processing routine in Step A812 aforementioned.

First, a document is fed and the third CPU 253 turns ON the solenoid of the selection claw 304 provided at the end portion of the side of R unit 350 of the document transport control portion 301, and the reversing motor 352 of the R unit 350 respectively by ON-EDGE of the sensor 307 and starts a timer D1 (Steps A831 to A833). That is, the selection claw 304 is switched so as to send a document toward the R unit 350 and to bring the R unit 350 in an operating state. A timer D1 is provided exactly for the same purpose as the timer A1, and the third CPU 253 turns OFF the document feed motor at time-up of the timer D1 (Steps A834, A835).

Then, when the transport belt motor 306 is rotated in the normal direction and ON-EDGE of the document detecting sensor 351 of the R unit 350 is detected, namely, the front edge of the document enters into the R unit 350, the third CPU 253 sets the flag K (Steps A836 to A838). When OFF-EDGE of the document detecting sensor 351 is detected or the document enters entirely to the rear edge into the R unit 350 by setting of the flag K, the third CPU 253 resets the flag K and reverses the transport belt motor 306 (Steps A839 to A842).

Then, when ON-EDGE of the document detecting sensor 351 is detected again during reverse rotation of the transport belt motor 306, or when the reversed document starts to come out from the R unit 350, the third CPU 253 starts a timer D2 (Steps A843 to A845). In the timer D2, the time for the reversed document to reach a predetermined copying position on the document table 35 by the transport belt 305 being rotated reversely after detected by the document detecting sensor 351 is set.

Then, at time-up of the timer D2, the third CPU 253 turns OFF entirely the solenoid of the selection claw 304, transport belt motor 306 and reversing motor 352, and sends the document fixed position signal to the first CPU 201 (Steps A846 to A850).

As described hereinabove, in the present routine in which both sides of the document are copied, the document is adapted to be reversed so as to be copied first from the rear side. This is because that, by copying the surface side later, the document is not discharged upside down into the discharge tray of the sorter or the like.

Now, the third CPU 253 judges whether or not a document is set at a fixed position and scanning of a predetermined number of copies is completed by the document feed processing routine in Step A811 or the document feed reverse processing routine in Step A812 described hereinabove in conjunction with FIG. 24, if completed, the third CPU 253 sets the scan end flag (Step A813 and A814).

When both sides of a document have to be copied, first, one side or the rear side is scanned by a prescribed number of sheets in Step A812, and paper to be copied onto which only the rear side of the document is copied are stocked in the main body of the present apparatus 1 so as to be fed again when copying the surface side to be described later.

Then, the third CPU 253 determines the two-side document signal in Step A816, and if the signal is "0" or the document is one-side, resetting the surface flag and scan end flag respectively and calls the document discharge processing routine (Steps A818 and A819).

When the two-side document signal is "1" and the surface flag is "1", or when only the rear side of the two-side document has been copied, the third CPU 253 calls the document reverse processing routine (Steps A816, A817 and A820).

Figure 27:
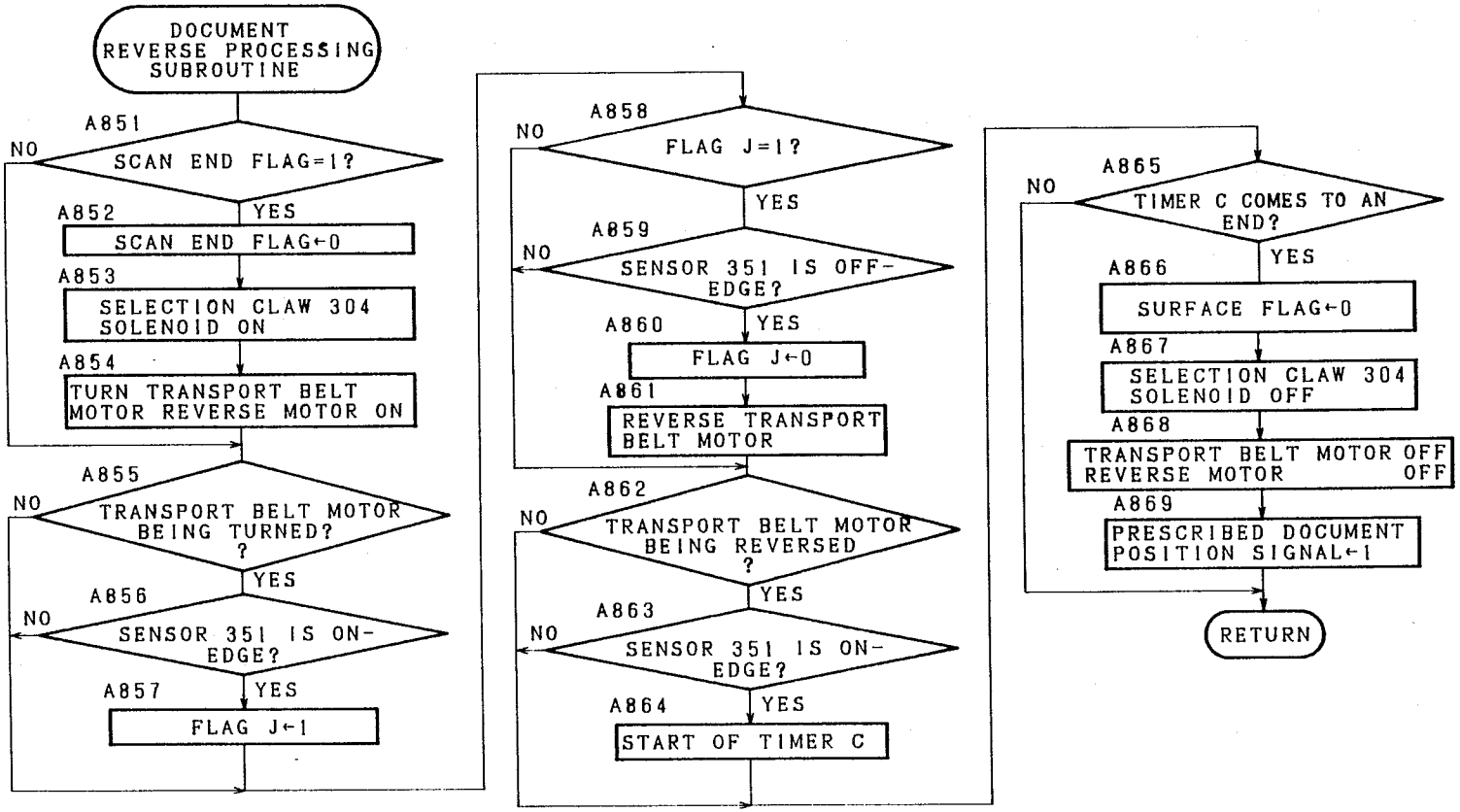

FIG. 27 shows the document reverse processing routine in Step A820.

When the scan end flag becomes "1", the third CPU 253 resets the flag (Steps A851 and A852). Then, the third CPU 253 excites the solenoid of the selection claw 304, rotating the transport belt motor 306 normally and turns ON the reversing motor 352 of the R unit 350 (Steps A853 and A854). Thereby, a document is introduced into the R unit 350.

Thereafter, the processing is substantially as same as the document feed reverse processing routine in aforesaid Step A812, whereby the two-side document whose rear side has been copied and positioned with the surface side up is reversed by the R unit 350, and discharged on the document table 35 with the rear side up so as to be set at a document fixed position at time-up of a timer C, then the third CPU 253 resets a surface flag (Steps A855 to A869).

Thereby, the surface side of the two-side document is copied, then, as Step A817 in FIG. 24 is "0", the third CPU 253 resets a scan end flag in the same way as the case of one-side document, and calls the document discharge processing routine in Step A819.

Figure 28:
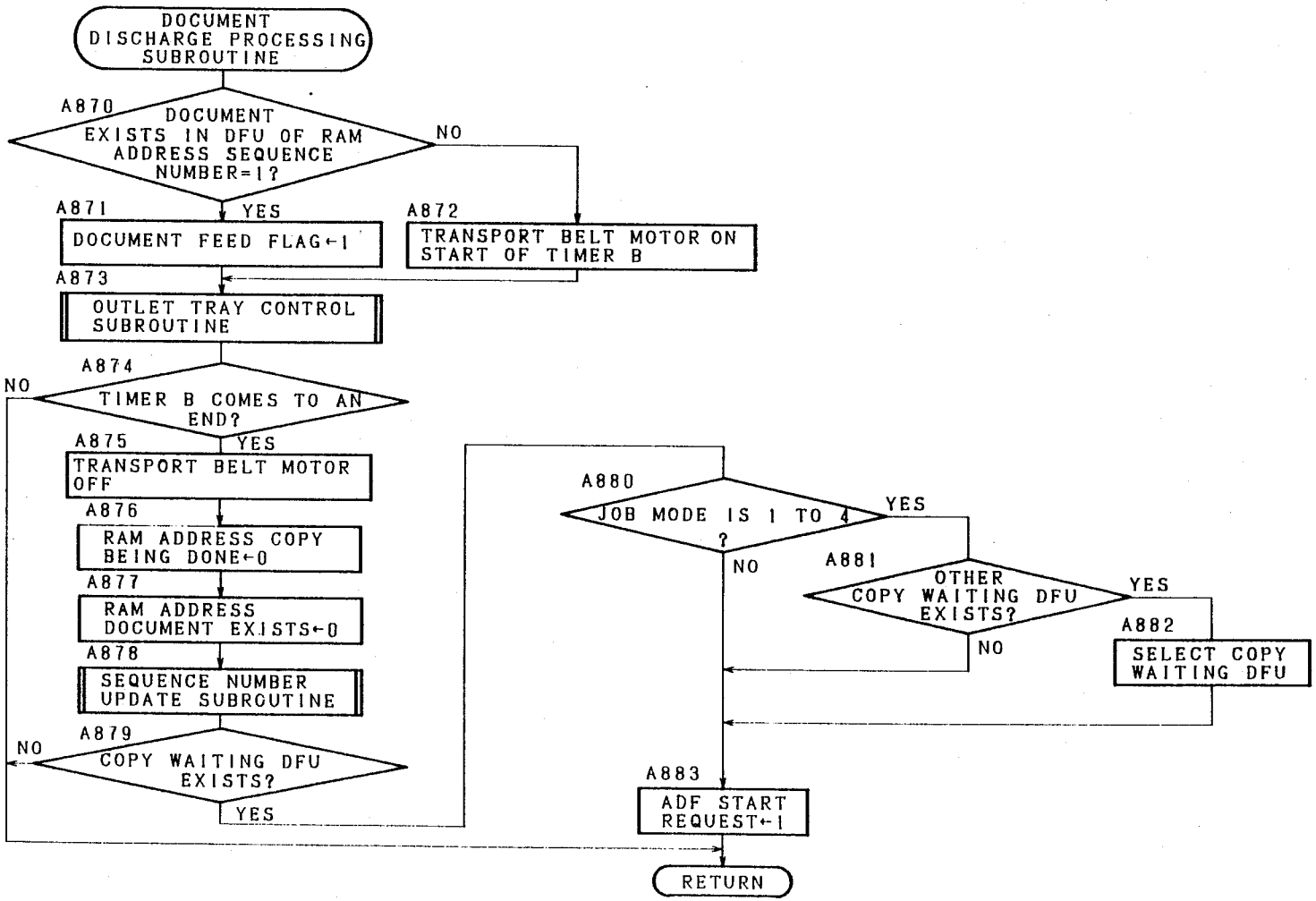

FIG. 28 shows the document discharge processing routine.

First, the third CPU 253 determines whether or not a document remains in the DFU whose "sequence number" is 1, if the document exists, it sets the document feed flag to "1". If no document exists, the transport belt motor 306 is turned ON to start a timer B (Steps A870 to A872). The timer B serves to control the transport belt motor 306 for sending the document to the discharge portion. In place of the timer B, a discharge sensor 308 may be used.

Figure 29:
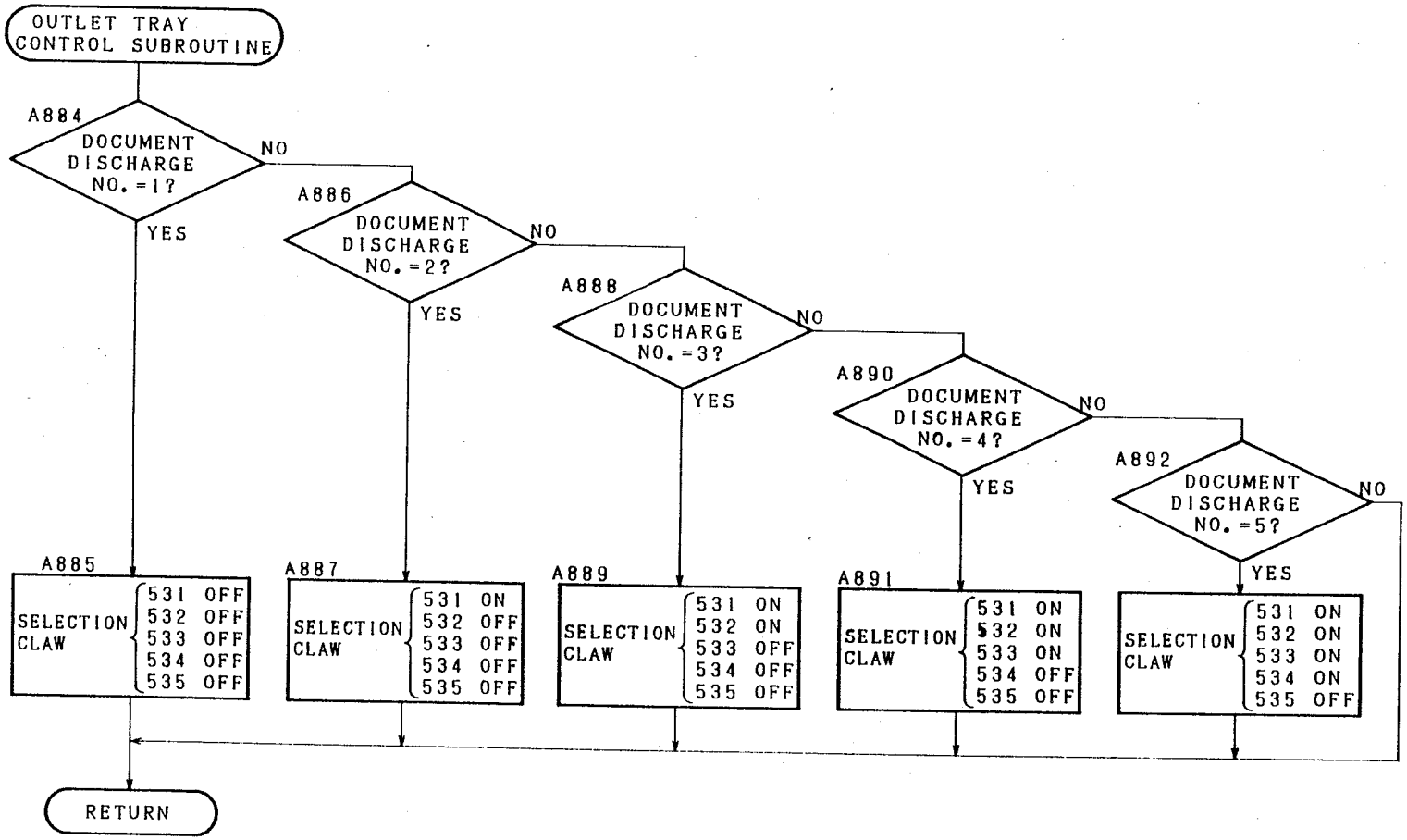

Then, the third CPU 253 calls the discharge tray control routine shown in FIG. 29 (Step A873).

In this routine, the third CPU 253 controls a paper passage 506 of the discharged document so that the document is discharged to a pre-selected DDU. When the document feed flag becomes "1", the document is fed and the transport belt motor 306 is turned ON. Thus, a new document and copied document are transported simultaneously by the transport belt 305, and the latter is processed by the discharge tray control routine.

As shown in FIG. 29, the discharge tray control routine controls to turn ON and OFF the electromagnetic solenoid for operating the document discharge passage selection claws 531 to 535 shown in FIG. 1, in response to the preset number in the discharge unit number area of the RAM map shown in FIG. 7.

For example, if the document which is being fed is discharged to the unit number "5" (Step A892), the third CPU 253 turns ON the selection claws 531 to 534 and turns OFF the selection claw 535 (Step A893). Thereby, the document passes smoothly through the transport passage 506 from the bottom to the top and when the document contacts the selection claw 535, it is discharged into the tray 515.

Now, for the last exposed document, the third CPU 253 turns OFF the transport belt motor 306 at time-up of the timer B in Step A874 in FIG. 26, bringing the RAM address "copy being done" of the DFU whose "sequence number" is 1 to "0" and sets the "document existence" to "0" (Steps A875 to A877).

Figure 30:
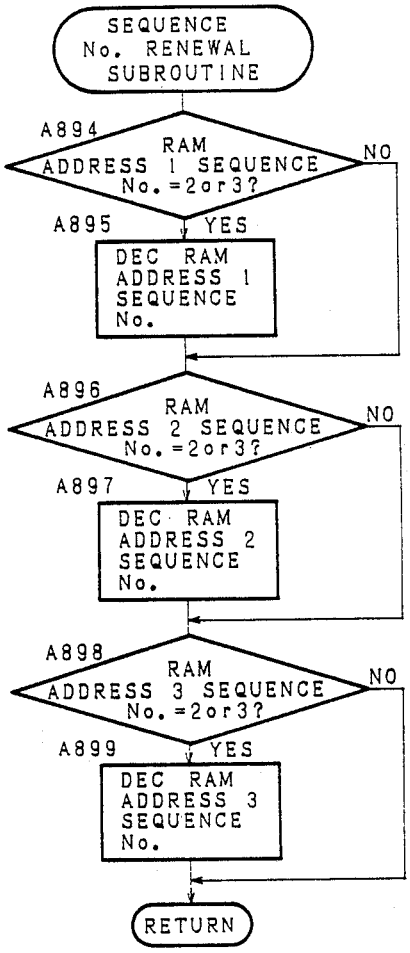

Then, the third CPU 253 calls the sequence number update routine in Step A878. In this routine, as shown in FIG. 30, the content of the sequence number area of the RAM address is judged when the copying processing for all the documents set in one DFU is completed, and the copying order is moved up by one.

In this embodiment, the DFU is constructed by connecting three DFUs and judge of the sequence number is made by discriminating between 2 and 3. If the sequence number is 2, it is moved up to 1, and if it is 3, it is moved up to 2 (Steps A894 to A899). When a new document is set in the DFU which is just completed, a numeral 3 is set in "sequence number" for the new document by a mode memory routine in FIG. 19.

When processing of the sequence number update routine is completed, the third CPU 253 judges at Step A879 in FIG. 28 whether or not there are any DFU waiting for copying. If such a DFU exists, the third CPU 253 judges whether or not the job mode of this DFU is set to any of 1 to 4 (Step A880). That is, when processing of one DFU is completed and the processing of a DFU set to the next sequence number is started, the third CPU 253 judges registration of the job mode of the DFU, and if it is not registered, sets the ADF start request to "1" in accordance with the sequence number to start processing (Step A883). However, when any of the modes of jobs 1 to 4 is registered in the DFU, the third CPU 253 judges whether or not there is the other DFU waiting for copying (Step A881), if such a DFU exists, which is selected with priority to start processing (Step A882).

When the other DFU waiting for copying does not exist in Step A881, or when the empty time occurs in the multi-job of the present apparatus, the third CPU 253 starts processing for the DFU in which the job mode is registered is started.

The DFU in which the job mode is registered and for which the processing is started in this manner is subjected to the predetermined processing by the job control routine of step A3 in FIG. 15 as aforementioned.

Figure 31:
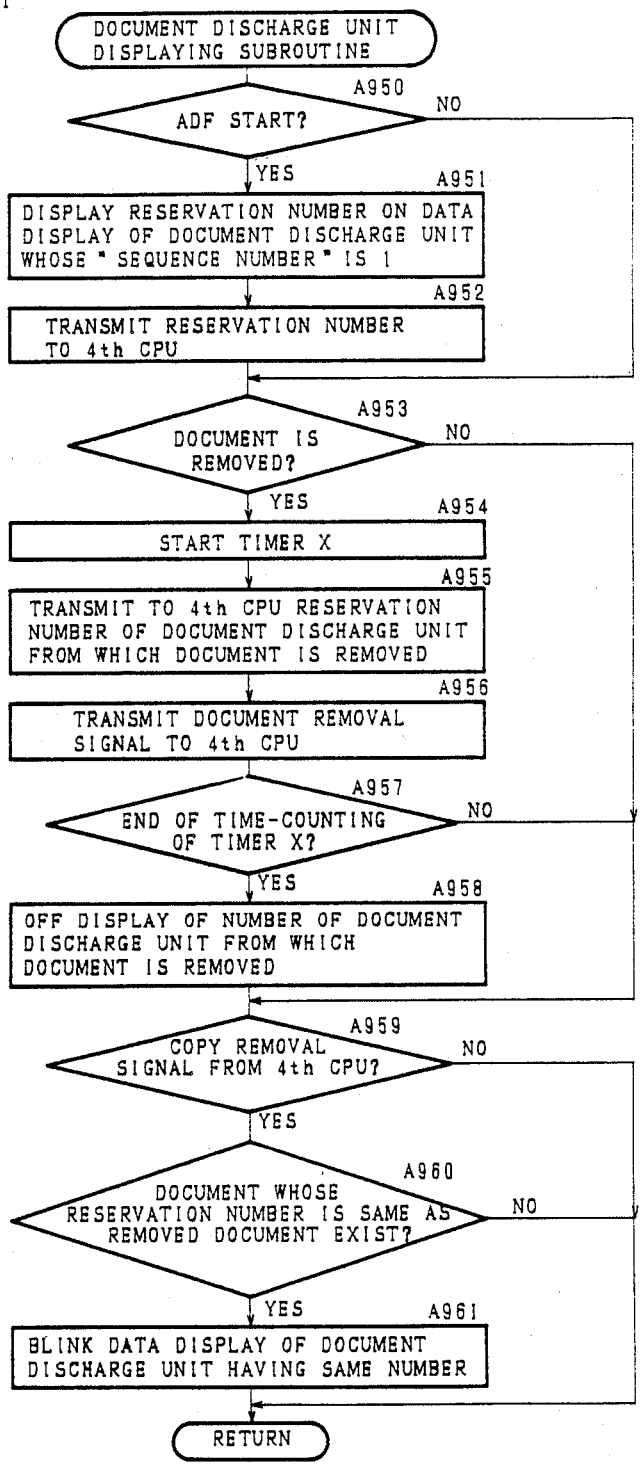

The step A9 in FIG. 15 is a document discharge unit displaying routine, and FIG. 31 shows a detailed flow chart thereof.

When the ADF is started, the third CPU 253 displays the reservation number on any of data displays 571 through 575 (refer to FIG. 3) of the selected document discharge units (DDUs) 501 through 505 for a group of documents to be processed, and transmits the reservation number to the fourth CPU 280 for sorter (step A950 through 952).

Next, when the copy operation is completed and the document is removed from any of the DDUs 501 through 505, the third CPU 253 makes a software timer X start time-counting of a predetermined duration (steps A953 and A954), and transmits the reservation number of the DDU wherefrom the document has been removed and a document removal signal to the fourth CPU 280 (steps A955 and A956). Then, at the time up of counting of the predetermined duration by the timer X, the third CPU 253 erases the display of the reservation number of the data display 571 (572 through 575) of the DDU 501 (502 through 505) wherefrom the document has been removed (step A958).

Furthermore, in case where a copied paper removal signal is sent from the fourth CPU 280, and the document of the same reservation number as that of the removed copied paper still remains in any of the DDUs 501 through 505, the third CPU 253 causes the data displays 571 through 575 of those DDUs 501 through 505 to blink (steps A959 through A961).

By the processing as described above, it can be made sure by displaying the reservation number that into which of the DDUs 501 through 505 the group of documents copied by the ADF has been discharged. Furthermore, the reservation number is displayed for a predetermined time even after the documents have been removed. Also, in case where the copied papers copied from that group of documents have been removed previously, the reservation number displayed on the DDUs 501 through 505 into which the documents of those copied papers have been discharged blinks, and therefore both the documents and the copied papers are prevented from being left by the user.

Now, control operation of the sorter will be explained.

Figure 32:
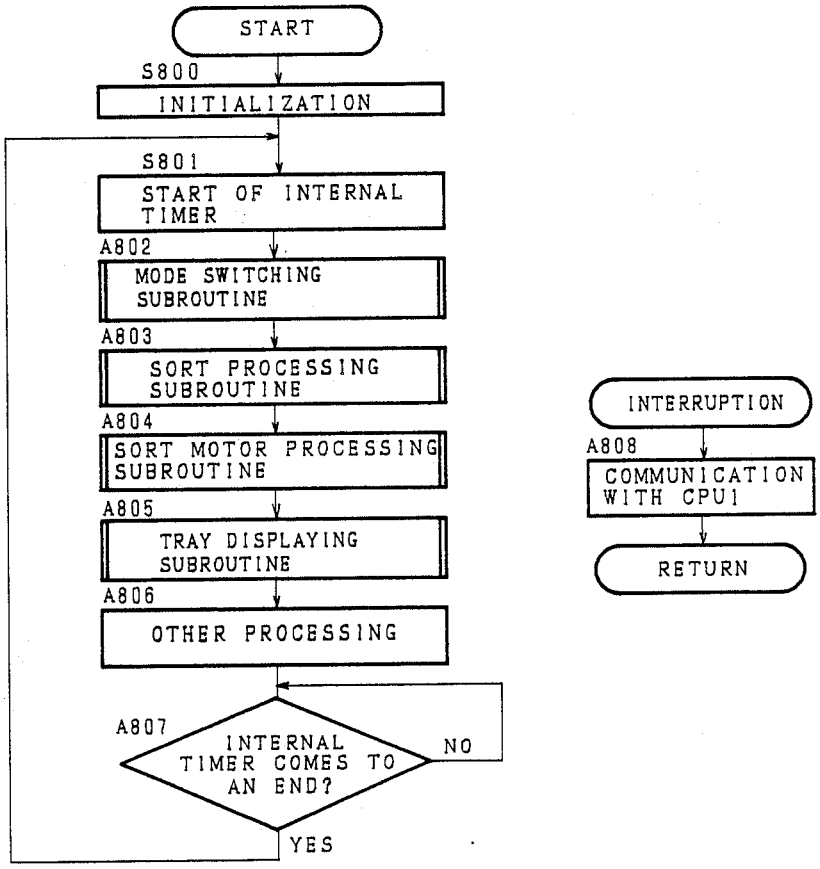

FIG. 32 shows a general flow chart of a program in a fourth CPU 280 for controlling the first and second sorters 600, 650.

When the program starts, the fourth CPU 280 makes initialization in Step S800 to clear an incorporated RAM and to set the contents of various registers. Then, the fourth CPU 280 starts an internal timer, calling successively the subroutine for sorter processing in Step S802 and the subroutine for sorter motor processing in Step S803, and judges completion of the internal timer in the final Step S805. When the internal time is completed, the fourth CPU 280 starts the timer again (Step S801) and repeats the loop to use the time for one routine of the loop in a clock of a software timer in the same way as the other CPUs.

When the interrupt request is made from the first CPU 201, the fourth CPU 280 makes communication therewith in Step S806.

Figure 33:
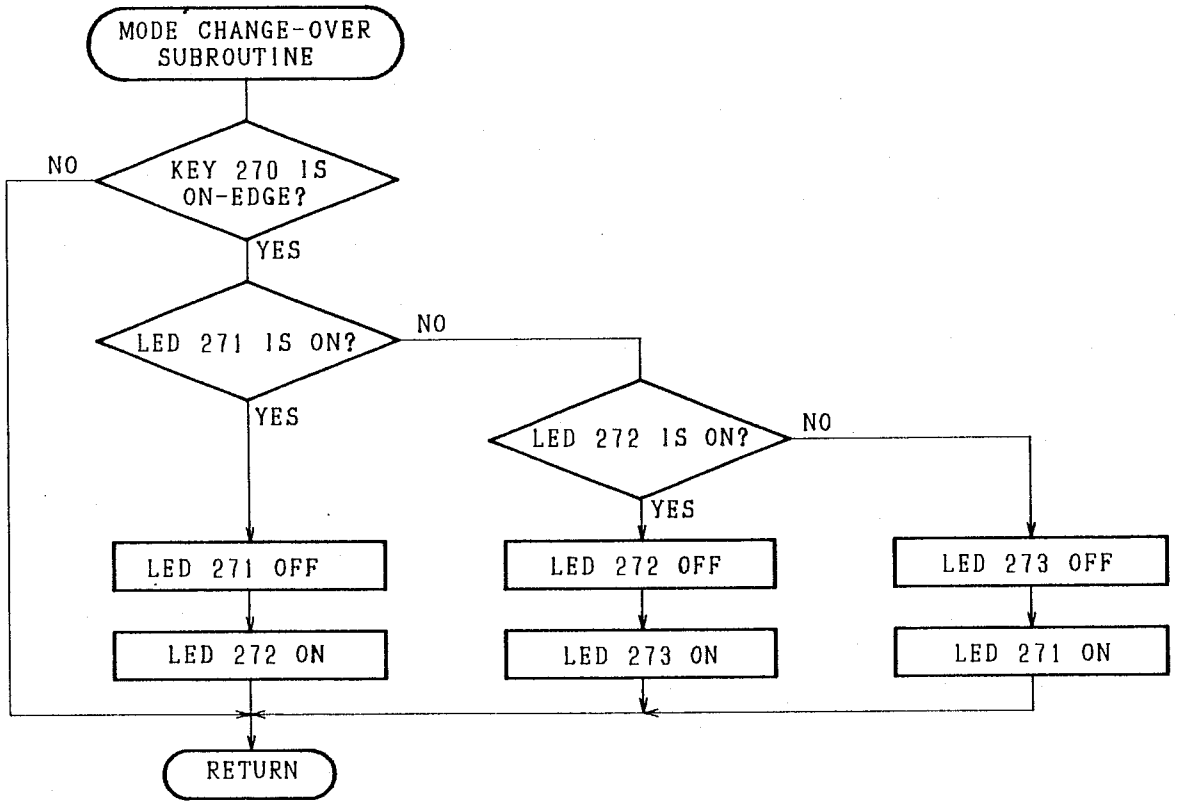

FIG. 33 shows a detailed flow chart of mode change-over processing of step S802 in FIG. 32.

The mode change-over processing is performed in a manner that the user operates a change-over key 290, and thereby, at ON-EDGE thereof, the mode is changed-over sequentially to the sorting mode, the grouping mode, non-sorting mode and the sorting mode again, and LED 291 through LED 293 indicating the setting of the respective modes are lit in sequence.

Figure 34A:
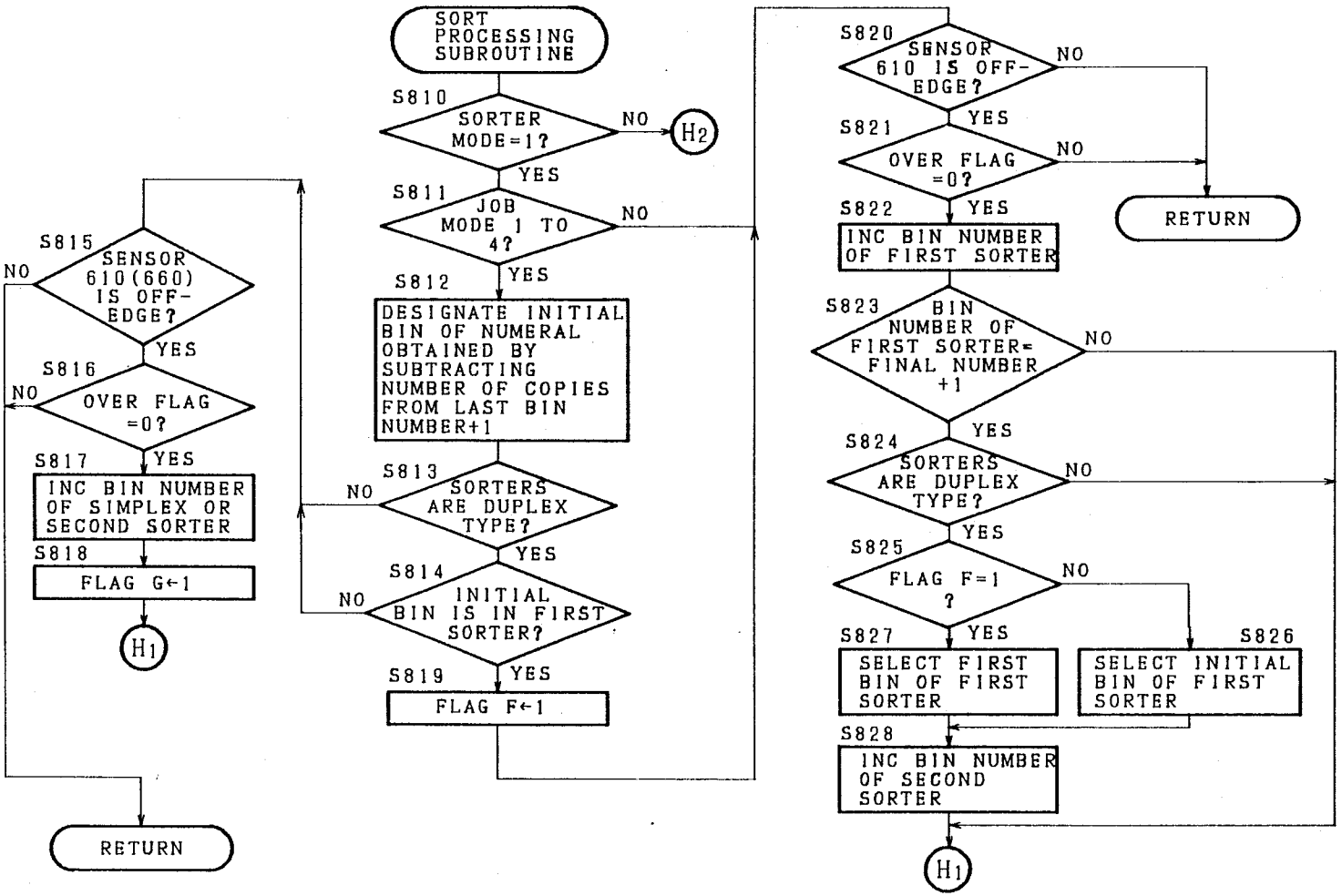
Figure 34:
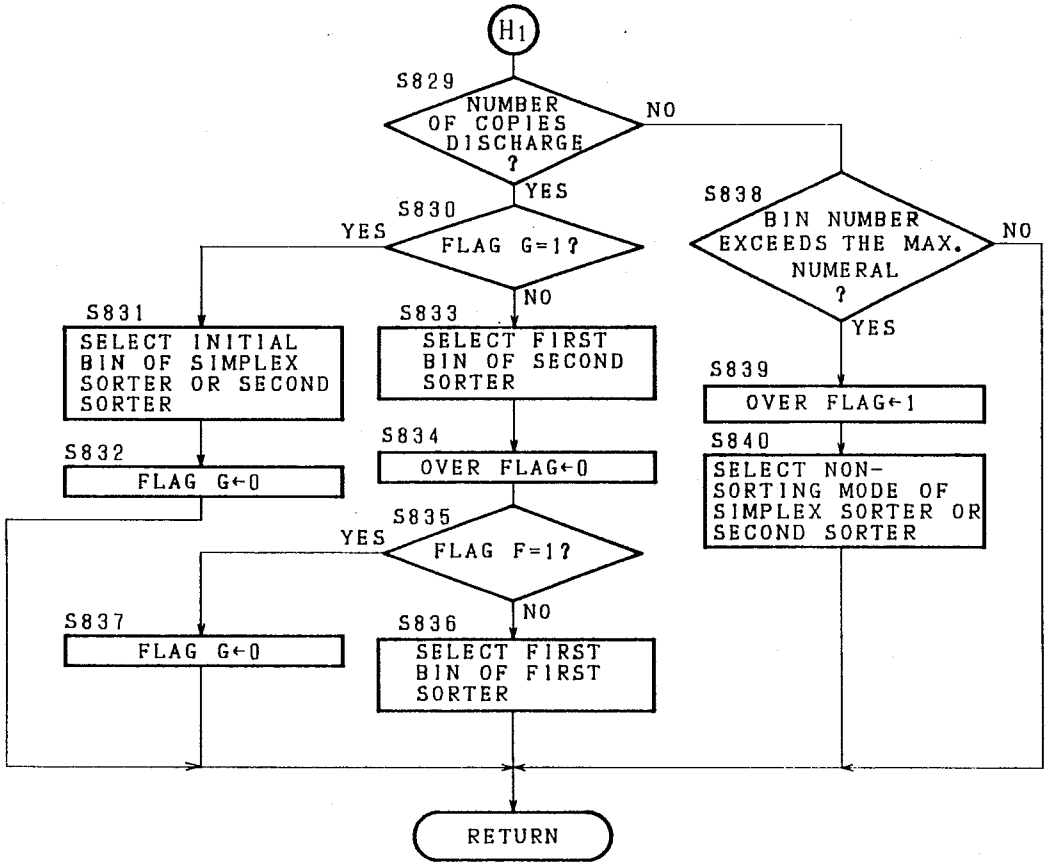

FIGS. 34(*a*), 34(*b*) and 35 show the sorting processing routine in Step S803.

When the "sorter mode" of the RAM address of the selected document feed unit is 1 in Step S810 or it is in the sorting mode, then, the fourth CPU 280 judges whether or not the "job mode" is set to any of 1 to 4 (Step S811). If it is set, in Step S812, the fourth CPU 280 designates a bin of a numeral obtained by subtrating the number of copies from a last bin number of the sorter plus one as an initial bin or the first bin of a series of bins to be used.

That is, since the number of bins of the job required in the sorting mode is equal to the number of copies, the bins are numbered in order from the last bin number of the maximum available number of bins in the system, or from the top bin of the first sorter 600 in the present embodiment. The initial bin number can be calculated by subtracting the number of document sheets from numeral obtained by adding one to the number given to the bottom bin of the second sorter 650. A series of bins from the initial bin to the last bin of the bottom stage of the second sorter 650 designated in this manner are allocated for the job. However, when the number of copies exceeds the number of bins available, the initial bin is numbered one or becomes the first bin.

When the initial bin is designated, then the fourth CPU 280 judges whether or not the sorters are a duplex type as shown in the present embodiment (Step S813). When it is the duplex type, the fourth CPU 280 judges whether or not the initial bin is in the first sorter 600, and if it is in the first sorter 600, sets the flag F to "1" and proceeds to Step S820. The fourth CPU 280 also proceeds to Step S820 when the job mode is not set in the aforesaid Step S811, or when use state of the sorter is normal.

While, when the sorter is not the duplex type but a simplex type, or when the intial bin is in the second sorter 650, the fourth CPU 280 proceeds to Step S815 in both cases.

That is, when the sorter is used normally and the job mode is set and the initial bin is designated in the first sorter 600, the fourth CPU 280 proceeds to Step S820. When the job mode is set and the initial bin is designated in the second sorter 650 or the sorter is the simplex type, the fourth CPU 280 proceeds to Step S815. Then, in Steps S820 and S821 or in Steps S815 and S816, the fourth CPU 280 detects OFF-EDGE of a sensor 610 (660), namely, transport of the copied paper from the sorting passage 615 (665) to the first bin (set initially at normal use) or to the designated initial bin. When the over flag indicating whether or not the number of copies exceeds the number of bins is 0, the fourth CPU 280 increments the bin number of the first sorter for the former case (Step S822). For the latter case, the fourth CPU 280 increments the bin number of the simplex sorter or the second sorter, setting the flag G to "1" (Steps S817, S818) and sorts copied paper to respective bins.

When the bin number of the first sorter becomes the final bin number of the first sorter plus one (Step S823) in the former case, namely, when the copied paper exceeds all the available bins of the first sorter before being discharged by the number of copies at normal use, or the copied paper are contained in all the bins from the initial bin designated by setting the job to the final bin of the first sorter, and in the case the second sorter is used next, the fourth CPU 280 judges in the following Steps S824, S825 whether or not the sorters are duplex type, or the flag F aforementioned is set.

When the second sorter is used next by setting the job mode, the fourth CPU 280 judges in Step S813 that the sorters are duplex type and selects the initial bin of the first sorter 600 in Step S827, since the flag F is set in Step S819, namely, the fourth CPU 280 returns the bin number to the initial bin for copied paper of the second document sheet, and increments the bin number of the second sorter 650 (Step S828). When, at normal use, the sorters are the duplex type, the fourth CPU 280 similarly selects the first bin of the first sorter (Step S826) and increments the bin number of the second sorter 650.

When the sorters are not the duplex type at normal use, the fourth CPU 280 judges in Step S838 that the bin number exceeds the maximum numeral or all the available bins of the simplex sorter. Then, the fourth CPU 280 sets the over flag, selecting the non-sorting mode of the simplex sorter (Steps S839, S840) and discharges the extra copied paper to the non-sorting tray. This non-sorting mode is selected similarly when the final bin number of the second sorter 650 is exceeded in the duplex type, and in this case, the first sorter 600 performs sorting.

When the copied paper for the first document sheet are discharged by the number of copies (Step S829), the fourth CPU 280 then judges the flag G (Step S830). When the flag G is set, or when sorting from the initial bin designated in the simplex sorter or the second sorter to respective final bins is completed, the fourth CPU 280 again selects the designated initial bin in Step S831, resetting the flag G to "0" (Step S832) and similarly sorts the copied paper for the second document sheet.

While, when the flag G is not set, namely, at normal use or when sorting from the initial bin designated in the first sorter 600 to the final bin of the second sorter 650 is completed, the fourth CPU 280 selects the first bin of the second sorter 650, resetting the over flag (Steps S833, S834) and judges a flag F in next Step S835. Since the flag F is not set at normal use, the fourth CPU 280 selects the first bin of the first sorter 600 (Step S836). When the flag F is set, the fourth CPU 280 resets the flag F (Step S837) and similarly sorts the copied paper for the second document sheet.

Figure 35:
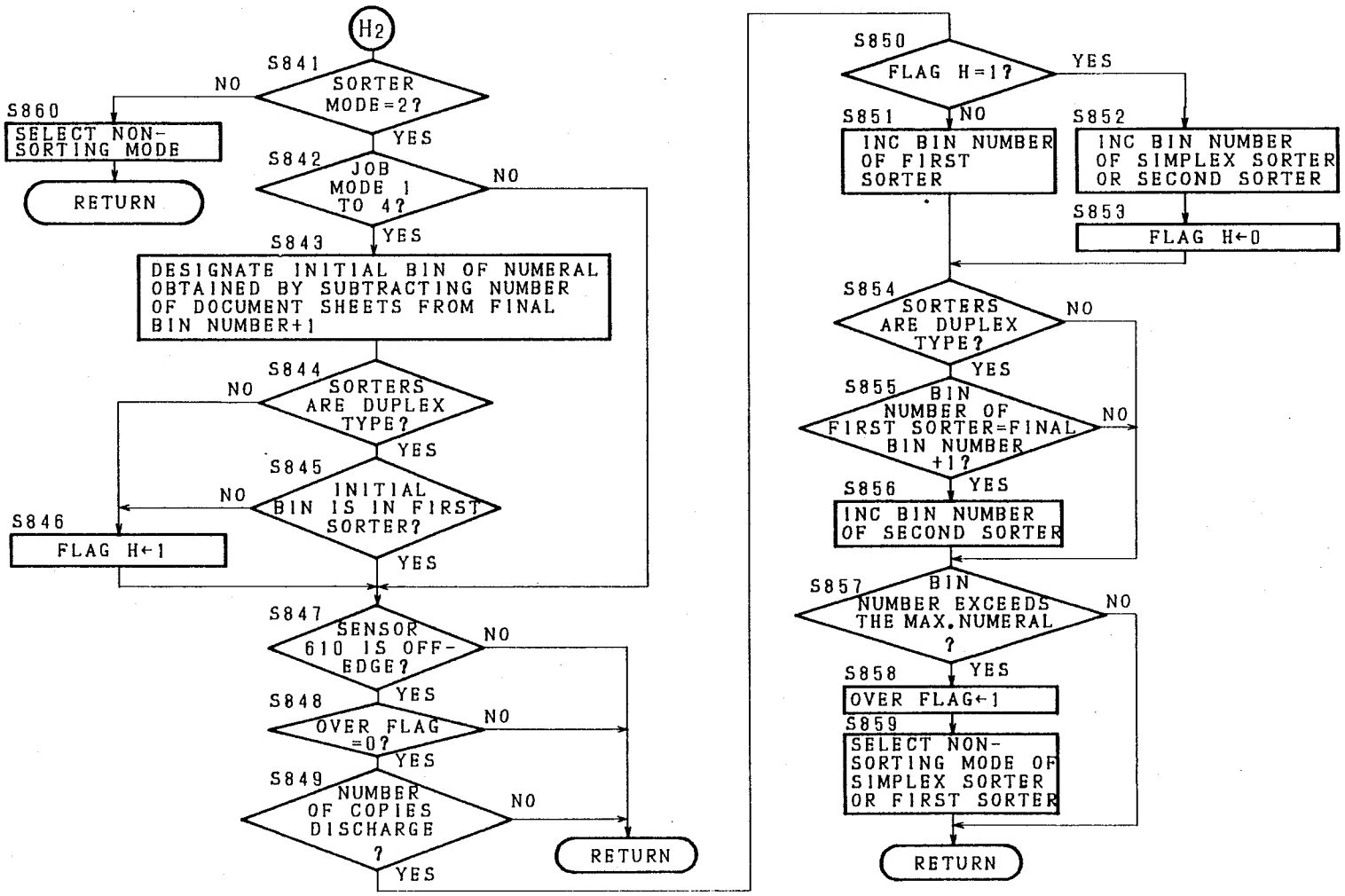

Now, in Step S810, when "sorter mode" is not 1 but 2, or when the grouping mode is set, in the same way as the sorting mode shown in FIG. 35, the fourth CPU 280 performs different processing according to whether the "job mode" is set to any of 1 to 4, or not set and in the ordinary sorter using state.

First, if the job mode is set, the fourth CPU 280 designates similarly the bin of numeral obtained by subtracting the number of document sheets from the final bin number of the sorter plus 1 as the initial bin in Step S843.

That is, the number of bins of the job used in the grouping mode is equal to the number of document sheets, and a series of bins from the initial bin to the final bin designated in this manner are allocated for the job.

Then, fourth CPU 280 judges whether or not the sorter is the duplex type. When the sorter is simplex type or the initial bin is designated in the second sorter 650 of the duplex type, the fourth CPU 280 sets a flag H to "1" (Step S844 through S846). Then, in the same way as the normal use, the fourth CPU 280 detects OFF-EDGE of the sensor 610, judging the over flag and discharges the copied paper by a predetermined number of copies into the initial bin. When this is completed, the fourth CPU 280 increments the bin number of the simple sorter or the second sorter 650 by the flag H which has been set, resetting the flag H and allocates the copied paper in group to respective bins till the final bin (Steps S847 to S853).

While, at normal use or when the initial bin is designated in the first sorter 600, the fourth CPU 280 increments the bin number of the first sorter 600 in Step S851 and allocates copied paper to respective bins in group in the same way as aforementioned. When shifted to bins of the second sorter 650 in the duplex type, the fourth CPU 280 judges it in Steps S854, S855 and increments the bin number of the second sorter 650 (Step S856).

When the bin number exceeds the maximum numeral in the system or the final bin at normal use, the fourth CPU 280 sets the over flag, and selects the non-sorting mode for itself if the sorter is simplex and for the first sorter 600 if duplex (Steps S857 through S859).

If the "sorter mode" is also not 2 or when it is 1 in the aforesaid Step S841, the fourth CPU 280 selects the nonsorting mode in Step S860.

Figure 36:
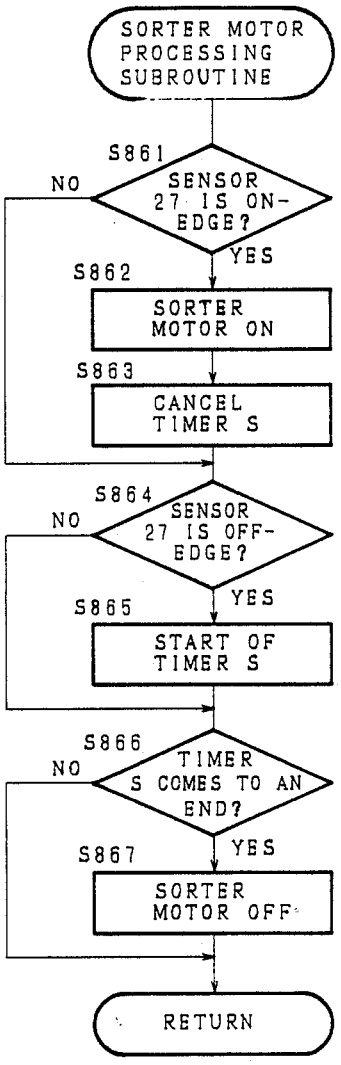

FIG. 36 shows a sorter motor processing routine of Step S804 in FIG. 31.

First, when the front edge of the copied paper to be discharged is detected at the paper outlet 26 of the main body of the present apparatus 1 by ON-EDGE of the sensor 27 (Step S861), the fourth CPU 280 turns ON the sorter motor 601 or both the 601 and 651 and then cancels a timer S (Steps S862 and S863). Then, if the rear edge of the copied paper is detected by OFF-EDGE of the sensor 27, the fourth CPU 280 starts the timer S (Steps S864 and S865).

In the timer S, the time for the copied paper to be transported in the passage in the sorter and distributed to respective bins is preset, and the fourth CPU 280 turns OFF the sorter motor at time-up of the timer S (Steps S866 and S867).

Figure 37:
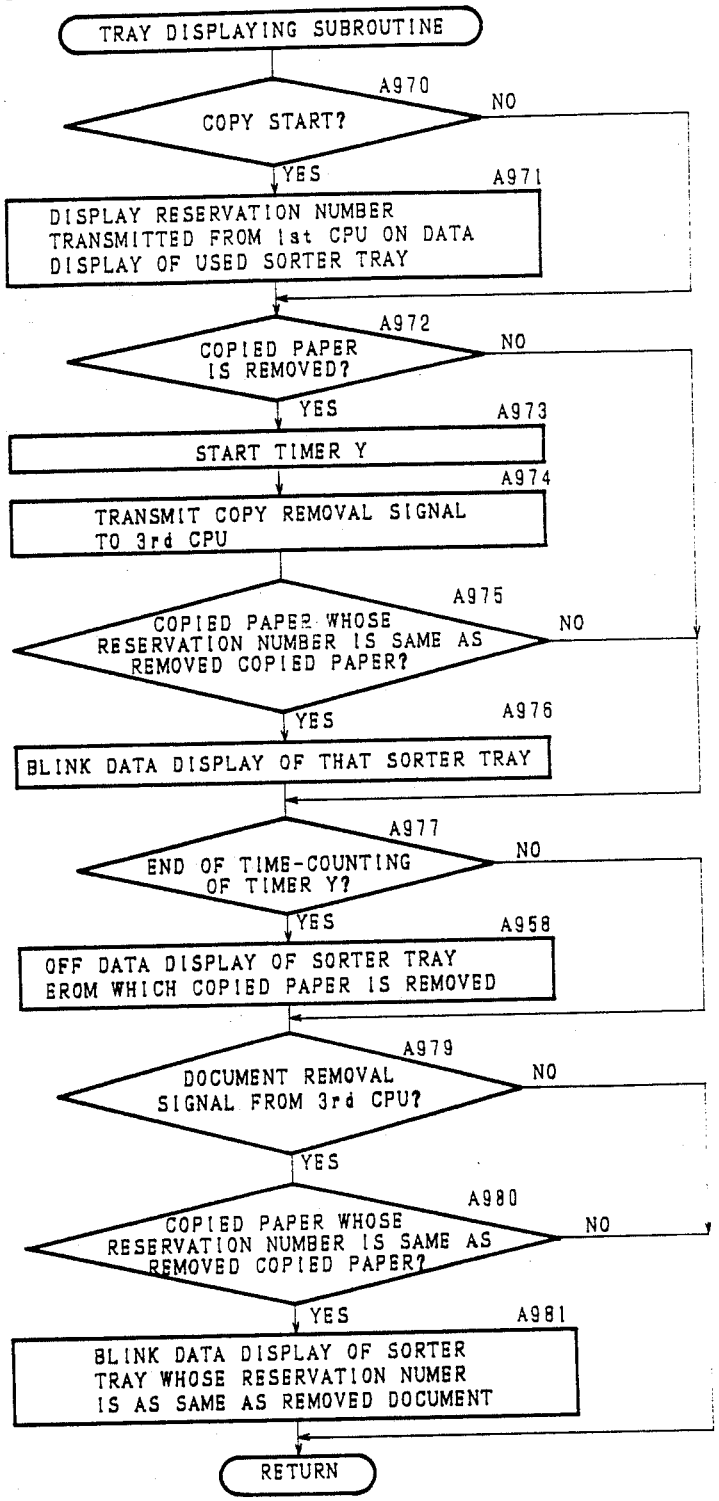

FIG. 37 shows a detailed flow chart of a tray displaying routine of step S805 in FIG. 32.

When copying operation starts, the reservation number (refer to step A952 in FIG. 31) transmitted from the third CPU 253 is displayed on any of the data displays 1001 through 1040 of the bins used for discharging copied papers among the sorter bins 620, 620 . . . , and 670, 670 . . . (steps A970 and A971).

Subsequently, when the copy processing is completed and the copied papers are removed from the bins, the fourth CPU 280 makes a software timer Y time-counting a predetermined duration, and transmits a copy removal signal to the third CPU 253 (steps A972 through A974, refer to step A959 in FIG. 31). Also, in case where the copied paper of the same reservation number as that of the removed copied papers remains in other bins, the fourth CPU 280 raises an alarm so as to leave no copied papers by causing the data displays art of that bins to blink (steps A975 and A976). Then, when time-counting of the timer Y expires in step A977, the fourth CPU 280 disappears display of the reservation number on the data displays of the bin from which copied papers are removed (step A978).

Thereafter, when the document removal signal is transmitted from the third CPU 253 (refer to step A956 in FIG. 31), the fourth CPU 280 checks whether or not the copied paper of the same reservation number as that of the removed documents exists, and if it exists, the fourth CPU 280 causes the data displays of that bins to blink to indicate the position (steps A979 through A981).

In brief, the DFU in which any of the job modes 1 to 4 is set starts copying operation of the document set therein, when copying operations of the documents in all the other DFU has been completed and the empty time has occurred. Then, according to the preset number of document sheets and copies and the processing mode of the sorter, the number of bins necessary for the copied paper is allocated from the final bin of the sorter so as to contain the copied paper therein. That is, copied paper which are not required immediately are contained in a series of bins including the final bin located in the most spaced position from the first bin into which the copied paper is usually contained when using the sorter. If the document is set newly in the other DFU without setting the job mode during copying operation including discharge processing to the sorter or after copying, copied paper for the new document are arranged to be used from the first bin of the sorter and contained as usual.

Furthermore, the registered reservation number is displayed on both the bin into which the documents have been discharged and the bin into which the copied papers of those documents have been discharged after the copying has been completed. For this reason, by finding either of the documents and the copied papers, the user can easily find the bin into which the copied papers or the documents have been discharged according to the reservation number displayed thereon.

Also, in case where the documents have been removed previously, the display of the bin wherein the copied papers copied from the removed documents are stored blinks, and in reverse, in case where the copied papers have been removed previously, the display of the bin wherein the documents from which removed copied paper are copied are stored blinks, and thereby the user is given a warning.

Also, in case where sorting mode is performed, all bins into which copied papers are stored raises alarm by removal of corresponding documents, and when copied papers in any of bins into which copied papers are sorted is removed, displays of the bins into which copied papers copied from same documents are stored blink and raises alarm, so that user does not forget to take out copied papers.

Furthermore, in case where a plurality of groups of documents to be copied have been set previously, by registering the receipt number of the documents, that number is displayed on both of the document discharge bin and the copied paper discharge bin, and therefore the user can take out the documents and copied papers of his own from the apparatus by taking a glance at them.

In addition, in the embodiment of the present invention, displays of the same number are used as a means for relating the document discharge bin with the copied paper discharge bin or as a means for relating each of the copied paper discharge bins with the same group of documents, and needless to say, it is also possible to take a configuration of displays of the same color or pattern.

As described above, in the copying apparatus in accordance with the present invention, in case where multi-job processing is performed using a plurality of document feed units and sorters, the display is performed wherein the documents and the copied paper obtained therefrom correspond mutually to the bins into which they have been discharged respectively, and therefore the user can easily find the bins into which the documents and the copied paper have been discharged.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A copying apparatus comprising:

a sorter which has a plurality of copied paper discharge bins and which operates by a plurality of processing modes relating to distribution of copied papers to a plurality of said bins, an automatic document feeder which has a plurality of document discharge bins, performs copy processing of a plurality of groups of documents in a predetermined sequence, and discharges the documents after processing into predetermined bins among said document discharge bins, first information displaying means disposed on each said copied paper discharge bin of said sorter, second information displaying means disposed on each said document discharge bin of said automatic document feeder, and a controlling means for displaying informations correlated with the second information displaying means disposed on a document discharge bin into which each group of documents completed copy processing have been discharged and the first information displaying means disposed on one or a plurality of copied paper discharge bins into which the copied papers of the corresponding documents have been discharged after completing copy processing of each group of documents.

2. A copying apparatus as set forth in claim 1, wherein said correlated informations are the same number.

3. A copying apparatus as set forth in claim 2, wherein said informations are blinking displayed.

4. A copying apparatus as set forth in claim 1, wherein said correlated informations are the same color.

5. A copying apparatus as set forth in claim 4, wherein said informations are blinking displayed.

6. A copying apparatus as set forth in claim 1, wherein said correlated informations are the same pattern.

7. A copying apparatus as set forth in claim 6, wherein said informations are blinking displayed.

8. A copying apparatus comprising:

a sorter which has a plurality of copied paper discharge bins and which operates by a plurality of processing modes relating to distribution of copied papers to a plurality of said bins, an automatic document feeder which has a plurality of document discharge bins, performs copy processing of a plurality of groups of documents in a predetermined sequence, and discharges the documents after processing into predetermined bins among said document discharge bins, first information displaying means disposed on each said copied paper discharge bin of said sorter, second information displaying means disposed on each said document discharge bin of said automatic document feeder, first sensors for detecting presence or absence of copied paper in each copied paper discharge bin of said sorter, second sensors for detecting presence or absence of document in each document discharge bin of said automatic document feeder, and a controlling means which, in case where removal of documents from any of a document discharge bins is detected by said second sensor, raises an alarm at the first information displaying means disposed on one or a plurality of copied paper discharge bins into which the copied papers of the removed documents have been discharged, and in case where removal of copied paper to be copied from any of the copied paper discharge bins is detected by said first sensor, raises an alarm at the second information displaying means disposed on the document discharge bin into which the documents corresponding to the removed copied papers have been discharged.

9. A copying apparatus as set forth in claim 8, wherein said alarm is blinking display of informations at said first or second information displaying means.

10. A copying apparatus comprising:

a sorter which has a plurality of copied paper discharge bins and which operates by a plurality of processing modes relating to distribution of copied papers to a plurality of said bins, an automatic document feeder which has a plurality of document discharge bins, performs copy processing of a pluralty of groups of documents in a predetermined sequence, and discharges the documents after processing into predetermined bins among said document discharge bins, information displaying means disposed on each copied paper discharge bin of said sorter, sensors for detecting presence or absence of copied paper in each copied paper discharge bin of said sorter, and a controlling means which, in case where removal of copied paper from any of the copied paper discharge bin is detected by said sensor, raises an alarm at the information displaying means disposed on one or a plurality of the other copied paper discharge bins into which the copied papers of the same group of documents of those copied papers to be copied have been discharged.

11. A copying apparatus as set forth in claim 10, wherein said alarm is blinking display of informations at said information displaying means.

12. A copying apparatus comprising:

a sorter which has a plurality of copied paper discharge bins and which operates by a plurality of processing modes relating to distribution of copied papers to a plurality of said bins, an automatic document feeder which has a plurality of document discharge bins, performs copy processing of a plurality of groups of documents in a predetermined sequence, and discharges documents after processing into predetermined bins among said document discharge bins, a registering means for registering identification information for identifying each group of documents, first information displaying means disposed on each said copied paper discharge bin of said sorter, second information displaying means disposed on each said document discharge bin of said automatic document feeder, and a controlling means which displays identification information registered by said registering means on the second information displaying means disposed on the document discharge bin and the first information displaying means disposed on one or a plurality of copied paper discharge bins into which the copied papers of the corresponding documents have been discharged after completing copy processing of each group of documents.

13. A copying apparatus as set forth in claim 12, wherein said identification information is a number.

14. A copying apparatus as set forth in claim 13, wherein said number is blinking displayed.

15. A copying apparatus as set forth in claim 12, wherein said identification information is a color.

16. A copying apparatus as set forth in claim 15, wherein said color is blinking displayed.

17. A copying apparatus as set forth in claim 12, wherein said identification information is a pattern.

18. A copying apparatus as set forth in claim 17, wherein said pattern is blinking displayed.

19. A copying apparatus comprising:

a document placing means for placing a plurality of groups each of which consists of one or plural sheets of documents, an identifying means for giving an identification code to each of said groups of documents, an exposing means for exposing a document, a supplying means for supplying documents one by one sheet from said placing means to said exposing means, an image forming means for forming an image of the document exposed in said exposing means onto a paper to be copied, a document storing means which has a plurality of discharge trays, and stores the documents after exposure, a controlling means for controlling said document storing means to store the documents after exposure in different trays one by one group, and a displaying means for displaying the identification code corresponding to the documents stored in each of said discharge trays.

20. A copying apparatus as set forth in claim 19, wherein said document placing means has a plurality of document trays, and a different group of documents is placed on each of said trays.

21. A copying aparatus as set forth in claim 19, wherein said identifying means gives a sequence in which a plurality of said groups of documents are to be copied.

22. A copying apparatus as set forth in claim 19, wherein said displaying means is provided on each of a plurality of said discharge trays.

23. A document feeder comprising:

a document placing means for placing a plurality of groups of documents each of which consists of one or plural sheets of documents, an identifying means for giving an identification code to each of said groups of documents, an exposing means for exposing a document, a supplying means for supplying documents one by one sheet from said placing means to said exposing means, a document storing means which has a plurality of discharge trays, and stores the documents after exposure, a discharge controlling means for controlling said document storing means to store documents after exposure in different trays one by one group, and a displaying means for displaying the identification code corresponding to the documents stored in each of said discharge trays.

24. A document feeder as set forth in claim 23, wherein said document placing means has a plurality of document trays, and a different group of documents is placed on each of said trays.

25. A document feeder as set forth in claim 23, wherein said identifying means gives a sequence in which a plurality of said groups of documents are to be copied.

26. A document feeder as set forth in claim 23, wherein said displaying means is provided on each of a plurality of said discharge trays.

27. A copying apparatus comprising:

a document placing means for placing a plurality of groups of documents each of which consists of one or plural sheets of documents, an identifying means for giving an identification code to each of said group of documents, an exposing means for exposing a document, a supplying means for supplying documents one by one sheet from said placing means to said exposing means, an image forming means for forming an image of the document exposed in said exposing means on a paper to be copied, a document storing means for storing documents after exposure, a copied paper storing means which has a plurality of storing parts and stores copied papers whereon images have been formed, a controlling means for controlling said copied paper storing means to store copied papers whereon images have been formed from different groups of documents in different storing parts respectively, and a displaying means for displaying the identification codes corresponding to the copied papers stored in each storing part of said copied paper storing means.

28. A copying apparatus as set forth in claim 27, wherein said document placing means has a plurality of document trays, and a different group of documents is placed on each of said trays.

29. A copying apparatus as set forth in claim 27, wherein said identifying means gives a sequence in which a plurality of said groups of documents are to be copied.

30. A copying apparatus as set forth in claim 27, wherein said displaying means is provided on each of a plurality of said discharge trays.

31. A copying apparatus as set forth in claim 27, wherein said document storing means has a plurality of discharge trays, and stores a different group of documents in each of said trays.

32. A copying apparatus comprising:

a document placing means for placing a plurality of groups of documents each of which consists of one or plural sheets of documents, an exposing means for exposing documents, a supplying means for supplying documents one by one sheet from said placing means to said exposing means, an image forming means for forming an image of the document exposed in said exposing means on a paper to be copied, a document storing means which has a plurality of discharge trays, and stores documents after exposure, a document detecting means for detecting presence or absence of document on each discharge tray of said document storing means, a first controlling means for controlling said document storing means to store documents after exposure in different trays one by one group, a copied paper storing means which has a plurality of storing parts, and stores copied papers whereon images have been formed, a second controlling means for controlling said copied paper storing means to store copied papers whereon images has been formed from different groups of documents in different storing parts respectively, and a displaying means which, in case where one of said groups of documents is removed from any of the discharge trays of said document storing means, displays the storing part storing the copied papers formed from the removed documents.

33. A copying apparatus as set forth in claim 32, wherein said document placing means has a plurality of document trays, and a different group of documents is placed on each of said trays.

34. A copying apparatus as set forth in claim 32, wherein said displaying means is provided in each storing part of said copied paper storing means.

35. A copying apparatus comprising:

a document placing means for placing a plurality of groups of documents each of which consists of one or plural sheets of documents, an exposing means for exposing a document, a supplying means for supplying documents one by one sheet basis from said placing means to said exposing means, an image forming means for forming an image of the document exposed in said exposing means on a paper to be copied, a document storing means which has a plurality of discharge trays and stores documents after exposure, a first controlling means for controlling said document storing means to store documents after exposure in different trays one by one group, a copied paper storing means which has a plurality of storing parts, and stores copied papers whereon images have been formed, a second controlling means for controlling said copied paper storing means to store copied papers whereon images have been formed from different groups of documents in different storing parts respectively, a copied paper detecting means for detecting presence or absence of copied paper in each storing part of said copied paper storing means, and a displaying means which, in case where the copied papers stored in the storing means are removed therefrom, displays the discharge tray storing the documents corresponding to the removed copied papers.

36. A copying apparatus as set forth in claim 35, wherein said document placing means has a plurality of document trays, and a different group of documents is placed on each of said trays.

37. A copying apparatus as set forth in claim 35, wherein said displaying means is provided in each storing part of said copied paper storing means.

38. A copying apparatus comprising:

a document placing means for placing a plurality of documents each of which consists of one or plural sheets of documents, an identifying means for giving an identification code to each of said groups of documents respectively, an exposing means for exposing a document, a supplying means for supplying documents one by one sheet from said placing means to said exposing means, an image forming means for forming an image of the document exposed in said exposing means on a paper to be copied, a document storing means which has a plurality of discharge trays, and stores documents after exposure, a first controlling means for controlling said document storing means to store documents after exposure in different trays one by one group, a first displaying means provided at the document storing means for displaying the identification codes corresponding to the documents stored in each discharge tray of said document storing means, a copied paper storing means which has a plurality of storing parts and stores copied papers, a second controlling means for controlling said copied paper storing means to store the copied papers formed from different groups of documents in different storing parts respectively, and a second displaying means provided at the copied paper storing means for displaying the identification code of the group of documents from which images formed on copied papers stored in each storing part of said copied paper storing means have been copied.

39. A copying apparatus as set forth in claim 38, wherein said document placing means has a plurality of document trays, and a different group of documents is placed on each of said trays.

40. A copying apparatus as set forth in claim 38, wherein said identifying means gives a sequence in which a plurality of said groups of documents are to be copied.

41. A copying apparatus as set forth in claim 38, wherein said first displaying means is provided on each tray of said document storing means.

42. A copying apparatus as set forth in claim 38, wherein said second displaying means is provided on each storing part of said copied paper storing means.

43. A copying apparatus comprising:

a document placing means for placing a plurality of groups of documents each of which consists of one or plural sheets of documents, an exposing means for exposing a document, a supplying means for supplying documents one by one sheet from said placing means to said exposing means, an image forming means for forming an image of the document exposed in said exposing means on a paper to be copied, a document storing means which has a plurality of discharge trays, and stores documents after exposure, a copied paper storing means which has a plurality of storing parts, and stores copied papers whereon images have been formed, a controlling means for controlling said copied paper storing means to distribute and store copied papers whereon images have been formed from the same group of documents into a plurality of storing parts of said copied paper storing means, a copied paper detecting means for detecting presence or absence of a copied paper on each storing part of said copied paper storing means, and a displaying means which, in case where the copied papers formed from one of said groups of documents and stored on one of the storing parts are removed therefrom, displays the other storing parts storing the copied papers formed from the same group of documents.

44. A copying apparatus as set forth in claim 43, wherein said document placing means has a plurality of document trays, and a different group of documents is placed on each of said trays.

45. A copying apparatus as set forth in claim 43, wherein said document storing means has a plurality of discharge trays, and stores a different group of documents on each of said trays.

46. A copying apparatus as set forth in claim 43, wherein said displaying means is provided on each storing part of said copied paper storing means.

* * * * *